US010773515B2

(12) United States Patent
Arakane et al.

(10) Patent No.: US 10,773,515 B2
(45) **Date of Patent: *Sep. 15, 2020**

(54) IMAGE RECORDING APPARATUS

(71) Applicant: Brother Kogyo Kabushiki Kaisha, Nagoya-shi, Aichi-ken (JP)

(72) Inventors: Satoru Arakane, Nagoya (JP); Kenji Kawamoto, Nagoya (JP); Tsuyoshi Ito, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/454,447

(22) Filed: Jun. 27, 2019

(65) Prior Publication Data

US 2020/0001598 A1 Jan. 2, 2020

(30) Foreign Application Priority Data

Jun. 29, 2018 (JP) ..... 2018-124191

(51) Int. Cl.
*B41J 2/045* (2006.01)

(52) U.S. Cl.
CPC ..... *B41J 2/04503* (2013.01); *B41J 2/04581* (2013.01)

(58) Field of Classification Search
CPC ..... B41J 2/04503; B41J 2/04508; B41J 2/04528; B41J 2/04551; B41J 2/04563; B41J 2/04581; B41J 2/04586; B41J 25/001
See application file for complete search history.

(56) References Cited

U.S. PATENT DOCUMENTS

2005/0195227 A1* 9/2005 Tanaka ..... B41J 2/04596 347/10
2009/0237744 A1 9/2009 Ogura et al.

FOREIGN PATENT DOCUMENTS

JP 2009-029037 A 2/2009
JP 2016-137674 A 8/2016

* cited by examiner

*Primary Examiner* — Thinh H Nguyen
(74) *Attorney, Agent, or Firm* — Banner & Witcoff, Ltd.

(57) ABSTRACT

An image recording apparatus includes a carriage which reciprocatingly moves in a scanning direction, a head mounted on the carriage to jet liquid, a speed sensor which acquires speed data related to speed of the carriage, and a controller configured to: record an image by executing a recording pass in which the liquid is jetted from the head toward a recording medium while moving the carriage once toward one side in the scanning direction; determine whether the speed indicated by the speed data is lower than a threshold value during the recording pass; and based on determination that the speed indicated by the speed data is lower than the threshold value at a first point of time in the recording pass, determine whether to suspend or continue the recording pass by referring to the speed data acquired after a predetermined time since the first point of time.

13 Claims, 27 Drawing Sheets

WHEN JAM OCCURS

WHEN VIBRATION OCCURS

IMAGE RECORDING APPARATUS

CROSS REFERENCE TO RELATED APPLICATION

The present application claims priority from Japanese Patent Application No. 2018-124191 filed on Jun. 29, 2018, the disclosure of which is incorporated herein by reference in its entirety.

BACKGROUND

Field of the Invention

The present invention relates to an image recording apparatus.

Description of the Related Art

Japanese Patent Application Laid-open No. 2016-137674 discloses a serial printer as an example of image recording apparatuses where printing is carried out by jetting ink from a head onto a recording paper while moving a carriage, on which the head is mounted, in a scanning direction. However, in the printer of such a type, because the recording paper absorbs the ink jetted from the head and then deforms, graze (paper jam or jam) may occur between the recording paper and the head when the carriage is moving. With such graze, if the carriage continues moving, then it is possible to give rise to damage and the like of the head.

On this occasion, when the carriage is moving, if the graze occurs between the recording paper and the head, then the speed of the carriage will decrease due to the frictional force between the recording paper and the head. By making use of this phenomenon, according to the printer disclosed in Japanese Patent Application Laid-open No. 2016-137674, when the carriage is moving, if the speed of the carriage decreases to be below a preset threshold value, then the carriage is stopped to suspend the printing based on determination that the jam is occurred.

SUMMARY

However, the speed of the moving carriage may also decrease due to other causes than the graze between the recording paper and the head. For example, when the carriage is moving, the speed of the carriage may decrease because some temporal vibration is applied to the printer from the outside. In the printer disclosed in Japanese Patent Application Laid-open No. 2016-137674, when the speed of the carriage decreases due to other causes than the graze as in such cases, there is possibility that the printing is unnecessarily suspended based on incorrect determination that the graze is occurred although such graze is not occurred actually.

An object of the present teaching is to provide an image recording apparatus capable of reducing the possibility of damaging the head while lowering the possibility that an image recording is unnecessarily suspended.

According to an aspect of the present teaching, there is provided an image recording apparatus including: a carriage configured to reciprocatingly move in a scanning direction; a head mounted on the carriage and configured to jet liquid; a speed sensor configured to acquire speed data related to speed of the carriage; and a controller configured to: record an image on a recording medium by carrying out a recording pass in which the liquid is jetted from the head toward the recording medium while moving the carriage once toward one side in the scanning direction; determine whether the speed indicated by the speed data acquired by the speed sensor is lower than a predetermined threshold value when moving the carriage in the recording pass; and based on determination at a first point of time in the recording pass that the speed indicated by the speed data is lower than the threshold value, determine whether to suspend or continue the recording pass while moving the carriage, by referring to the speed data acquired by the speed sensor at a second point of time in the recording pass which is after a predetermined time since the first point of time.

The present inventors have discovered that between the time when the carriage speed falls lower than the threshold value due to a graze arising between the head and the recording medium, and the time when the carriage speed falls lower than the threshold value due to another cause than the graze, the carriage speed changes differently in aspect after the point of time of falling lower than the threshold value. Hence, according to the present teaching, at the first point of time where the carriage speed is determined as lower than the threshold value, without determining whether to suspend or continue the recording pass, the determination is made by referring to the speed data acquired by the speed sensor at the second point of time during the recording pass, after the predetermined time has elapsed since the first point of time. As a result, it is possible to lower the possibility of damaging the head while reducing the possibility of unnecessary suspension of recording the image.

BRIEF DESCRIPTION OF THE DRAWINGS

FIGS. 5A to 5C are illustration graphs for explaining a relationship between a carriage speed and a threshold value, wherein FIG. 5A shows a normal state, FIG. 5B shows a case where a paper jam occurs, and FIG. 5C shows a case where a vibration occurs.

DESCRIPTION OF THE EMBODIMENTS

First Embodiment

Figure 1:
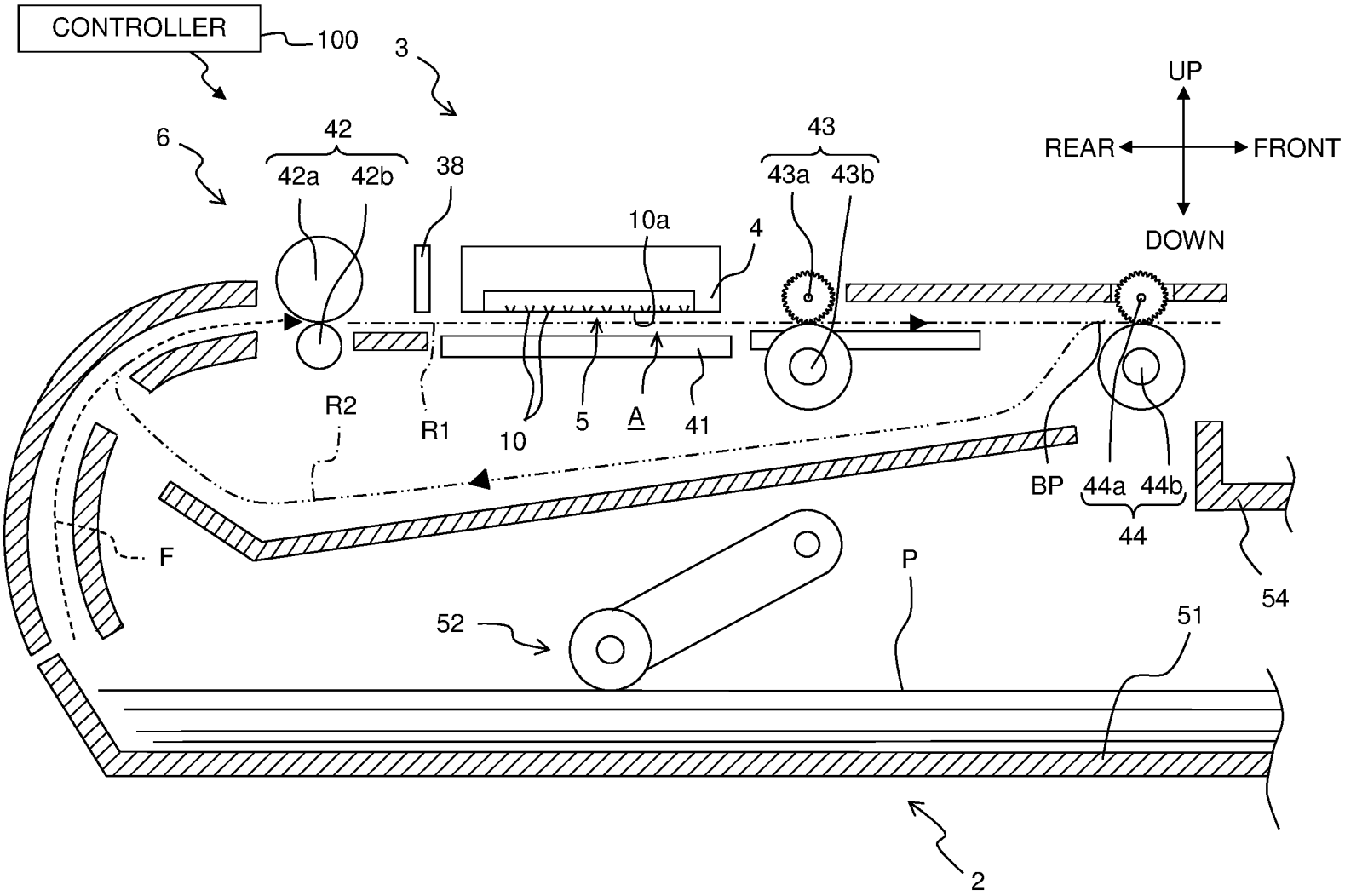
FIG. 1 is a schematic vertical cross-sectional view of an ink jet printer according to a first embodiment of the present teaching.
Figure 2:
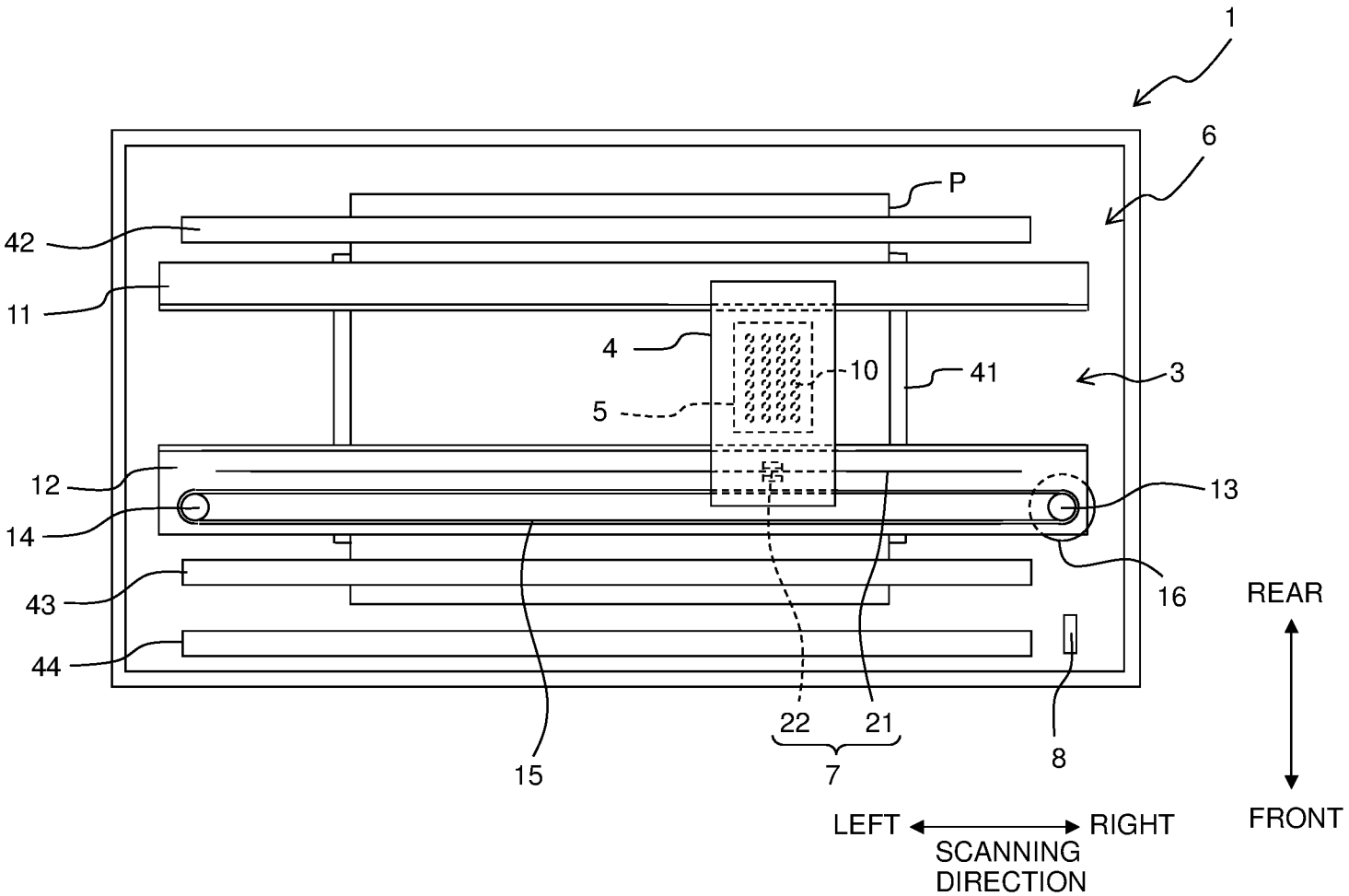
FIG. 2 is a schematic plan view of the ink jet printer.

Hereinbelow, an ink jet printer 1 will be explained as an example of image recording apparatuses. Further, in the following explanation, as shown in FIGS. 1 and 2, a definition is made to determine mutually orthogonal front/rear direction, left/right direction, and up/down direction. As shown in FIG. 1, the printer 1 includes a feeding unit 2, a recording unit 3, a controller 100, and the like.

The feeding unit 2 has a paper feeding tray 51 on which (recording) paper P is loaded as a recording medium, a pickup roller 52 provided above the paper feeding tray 51, and a feeding path F through which the paper P is fed. The feeding path F extends from the upper end of the rear wall of the paper feeding tray 51, curves upward, and then reaches to an aftermentioned conveyance roller pair 42. Under the control of the controller 100, the pickup roller 52 picks up the paper P one sheet by one sheet from the paper feeding tray 51 when a paper feeding motor 53 (see FIG. 4) is driven. The paper P picked up by the pickup roller 52 is supplied to the recording unit 3 through the feeding path F.

The recording unit 3 carries out image recording on the paper P. In the first embodiment, the recording unit 3 has, as the recording modes, a one side recording mode for recording image only on a first side of the paper P, and a both side recording mode for recording image on both of the first side of the paper P and a second side which is the other side than the first side.

The recording unit 3 includes, as shown in FIG. 2, a carriage 4, an ink jet head 5 (to be referred to below as the head 5), a conveyance mechanism 6, an encoder 7, a temperature sensor 8 a touch panel 9 (see FIG. 4), and the like. The carriage 4 is supported by two guide rails 11 and 12 extending in the left/right direction. The two guide rails 11 and 12 are arranged at an interval in the front/rear direction. Pulleys 13 and 14 are provided in two end portions of the upper surface of the guide rail 12 in the left/right direction. An endless belt 15 made of a rubber material is stretched on and around the pulleys 13 and 14. The carriage 4 is fitted on such a part of the belt 15 as positioned between the pulley 13 and the pulley 14. Further, a carriage motor 16 is connected to the pulley 13 at the right side. Then, if the carriage motor 16 is caused to rotate positively and negatively in turn, then the pulleys 13 and 14 rotate to run the belt 15 such that the carriage 4 moves reciprocatingly in the left/right direction as a scanning direction. On this occasion, the pulley 14 at the left side rotates along with the running of the belt 15.

The head 5 is mounted on the carriage 4 to move reciprocatingly in the scanning direction together with the carriage 4. The head 5 has a nozzle surface 10*a* (see FIG. 1) which is its lower surface where a plurality of nozzles 10 are formed for jetting an ink. Further, the head 5 includes a plurality of ink flow channels in communication with the plurality of nozzles 10, and an actuator including a plurality of drive elements which apply a pressure to the ink in the ink flow channels to jet the ink respectively from the plurality of nozzles 10. While the actuator is not limited to any specific configuration, it is possible to preferably adopt a piezoelectric actuator having piezoelectric elements as the drive elements, for example, to apply the pressure to the ink by making of use of deformation of a piezoelectric layer due to the inverse piezoelectric effect. Note that it is also possible to adopt heater elements as the drive elements for producing air bubbles in the ink by heat.

The conveyance mechanism 6 is configured to convey the paper P sent in by the feeding unit 2 in the front/rear direction as a conveyance direction intersecting the scanning direction. As shown in FIG. 1, the conveyance mechanism 6 includes a platen 41, a first conveyance path R1, a second conveyance path R2, the two conveyance roller pairs 42 and 43, and a switchback roller pair 44.

The platen 41 is arranged below the carriage 4 and in a position capable of facing the carriage 4. The platen 41 has a larger width than the paper P along the left/right direction to support the paper P from below in image recording.

The first conveyance path R1 extends linearly frontward from the conveyance roller pair 42. Then, in order from the upstream side of the first conveyance path R1, the conveyance roller pair 42, the conveyance roller pair 43, and the switchback roller pair 44 are arranged. The second conveyance path R2 is configured to link the feeding path F with a position BP between and the conveyance roller pair 43 and the switchback roller pair 44, on the first conveyance path R1.

The two conveyance roller pairs 42 and 43 are arranged to interpose the head 5 in the front/rear direction. The conveyance roller pair 42 (an example of the upstream roller pair of the present teaching) is arranged at the upstream side of the head 5 in the conveyance direction. The conveyance roller pair 42 has an upper roller 42*a* and a lower roller 42*b* and, with those rollers, nips the paper P fed from the feeding unit 2 in the up/down direction to convey the paper P along the first conveyance path R1 in the conveyance direction. The upper roller 42*a* is a driving roller driven by a conveyance motor 45 (see FIG. 4). The lower roller 42*b* is a driven roller which rotates following the rotation of the upper roller 42*a*.

The conveyance roller pair 43 (an example of the downstream roller pair of the present teaching) is arranged at the downstream side of the head 5 in the conveyance direction. Further, the conveyance roller pair 43 has an upper roller 43*a* and a lower roller 43*b* and, with those rollers, takes in the paper P from the conveyance roller pair 42 to nip the paper P in the up/down direction and further convey the same in the conveyance direction. The lower roller 43*b* is a driving roller driven by the conveyance motor 45 (see FIG. 4). The upper roller 43*a* is a spur being a driven roller which rotates following the rotation of the lower roller 43*b*.

The two conveyance roller pairs 42 and 43 are synchronized and driven to rotate by the conveyance motor 45, under the control of the controller 100, to convey the paper P fed from the feeding unit 2 along the first conveyance path R1. By virtue of this, the paper P is conveyed to an area A (see FIG. 1: to be referred to below as the opposed area A) which can face or oppose the carriage 4 above the platen 41. Note that a rotary encoder 40 (see FIG. 4) is provided at the rotary shafts of the conveyance roller pair 42 to output a pulse signal in accordance with the rotation of the conveyance roller pair 42. The controller 100 controls the conveyance of the paper P based on the pulse signal from the rotary encoder 40.

Further, as shown in FIG. 1, a paper sensor 38 is arranged between the conveyance roller pair 42 and the platen 41 in the conveyance direction. The paper sensor 38 detects whether or not the paper P is present at a detecting position between the conveyance roller pair 42 and the platen 41 in the conveyance direction along the first conveyance path R1. The controller 100 determines whether or not the paper P is positioned at the opposed area A based on the detected result by the paper sensor 38 and the content of controlling the conveyance motor 45.

Then, the controller 100 records the desirable image and the like on the surface of the paper P facing the head 5 (to be referred to below as the recording surface) by repetitively and alternately carrying out a recording pass to jet the ink while moving the head 5 together with the carriage 4 and a conveyance operation to convey the paper P in the conveyance direction with the two conveyance roller pairs 42 and 43 when the paper P is positioned in the opposed area A. That is, the printer 1 according to the first embodiment is a serial printer.

The switchback roller pair 44 has an upper roller 44*a* and a lower roller 44*b* and, with those rollers, can take in the paper P from the conveyance roller pair 43 to nip the paper P in the up/down direction and further convey the same in the conveyance direction. The lower roller 44*b* is a driving roller driven by the conveyance motor 45 (see FIG. 4). The upper roller 44*a* is a spur being a driven roller which rotates following the rotation of the lower roller 44*b*. Note that the torque of the conveyance motor 45 is transmitted to the switchback roller pair 44 via a transmission mechanism 46 (see FIG. 4) constructed from gears, driving shafts, and the like. The controller 100 is able to control the transmission mechanism 46 to switch the rotating direction of the switchback roller pair 44 between a positive rotation direction capable of conveying the paper P frontward and a negative rotation direction capable of conveying the paper P rearward.

Figure 3A:
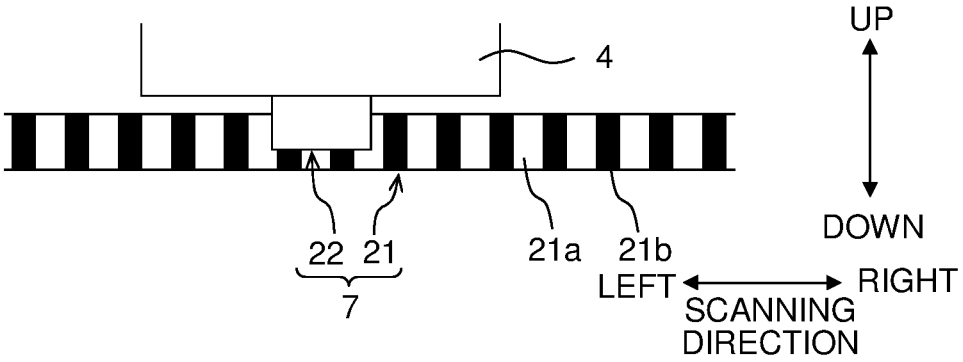
FIG. 3A shows an arrangement of an encoder's scale and a detecting sensor.

The encoder 7 is a linear encoder of transmission type and, as shown in FIG. 2 and FIGS. 3A to 3C, has a scale 21 and a detecting sensor 22. The scale 21 is arranged on the upper surface of the guide rail 12 to extend in the scanning direction across the movable area for the carriage 4. Further, as shown in FIG. 3A, in the scale 21, a plurality of transmission areas 21*a* and a plurality of non-transmission areas 21*b* are arranged alternately along the scanning direction. The respective transmission areas 21*a* have the same areal width along the scanning direction, and the respective non-transmission areas 21*b* also have the same areal width along the scanning direction. That is, on the scale 21, the plurality of transmission areas 21*a* are respectively formed at a predetermined interval (i.e., the areal width of the non-transmission areas 21*b*) along the scanning direction, while the plurality of non-transmission areas 21*b* are respectively formed at a predetermined interval (i.e., the areal width of the transmission areas 21*a*) along the scanning direction. Further, whereas the transmission areas 21*a* are areas through which light is transmitted, the non-transmission areas 21*b* are areas through which light is not transmitted.

The detecting sensor 22 is mounted on the carriage 4 and has a light-emitting element 26 and a light-receiving element 27. The light-emitting element 26 and the light-receiving element 27 are arranged to interpose the scale 21 therebetween in the front/rear direction. The light-emitting element 26 radiates light toward the light-receiving element 27. The light-receiving element 27 receives the light radiated from the light-emitting element 26. Then, the detecting sensor 22 detects any of the transmission areas 21*a* or any of the non-transmission areas 21*b* as the detecting position interposed between the light-emitting element 26 and the light-receiving element 27 on the scale 21.

Figure 3B:
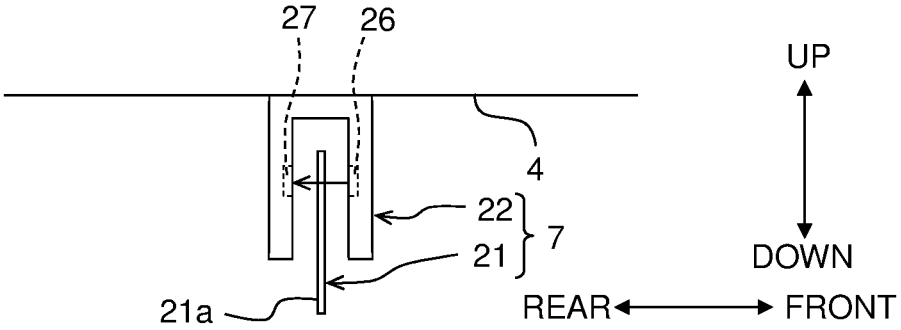
FIG. 3B shows a state of the detecting sensor facing a transmission area.
Figure 3C:
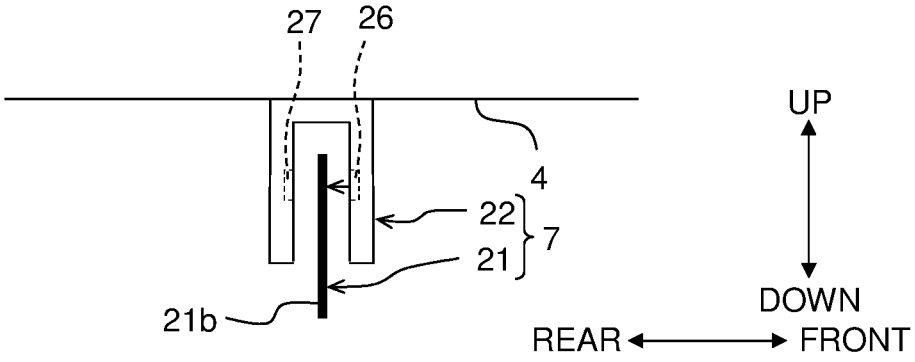
FIG. 3C shows a state of the detecting sensor facing a non-transmission area.

In particular, as shown in FIG. 3B, if the detecting position by the detecting sensor 22 is a transmission area 21*a*, then the light radiated from the light-emitting element 26 is transmitted through the transmission area 21*a* and received by the light-receiving element 27. On the other hand, as shown in FIG. 3C, if the detecting position by the detecting sensor 22 is a non-transmission area 21*b*, then the light radiated from the light-emitting element 26 is blocked by the non-transmission area 21*b* so as not to reach to the light-receiving element 27. Therefore, with the carriage 4 moving in the scanning direction, if the detecting position by the detecting sensor 22 moves, then the light-receiving element 27 switches alternately between the state of receiving the light from the light-emitting element 26 and the state of not receiving the light from the light-emitting element 26. The detecting sensor 22 outputs a pulse signal whose potential is V1 when the light-receiving element 27 does not receive the light from the light-emitting element 26, and whose potential is V2 when the light-receiving element 27 receives the light from the light-emitting element 26 (V2<V1). That is, the pulse signal outputted from the detecting sensor 22 denotes that the detecting sensor 22 is detecting the non-transmission area 21*b* when the potential is V1 while the detecting sensor 22 is detecting the transmission area 21*a* when the potential is V2.

The controller 100 calculates the speed of the carriage 4 (to be referred to below as a carriage speed Vcr) based on the pulse signal outputted from the detecting sensor 22. The carriage speed Vcr can be calculated with the following formula 1. Note that in the formula 1, W is the areal width of one non-transmission area 21*b* along the scanning direction, and G is the frequency of a clock signal outputted from an oscillation circuit 104 (see FIG. 4). Further, CK is the clock frequency of the clock signal outputted from the oscillation circuit 104 during the detecting sensor 22 detecting one non-transmission area 21*b*.

$$Vcr = W/(CK/G) \quad \text{(Formula 1)}$$

In the formula 1, because the areal width W and the frequency G have predetermined fixed values, the controller 100 can calculate the carriage speed Vcr by acquiring the clock frequency CK. Note that the clock frequency CK is obtained and the carriage speed Vcr is calculated each time the detecting sensor 22 detects one non-transmission area 21*b*. In the first embodiment, the carriage speed Vcr corresponds to the "speed data", and the "speed sensor" is realized by the encoder 7 and the controller 100.

The temperature sensor 8 is configured to measure the surrounding temperature and is arranged in the vicinity of the conveyance mechanism 6. The touch panel 9 is a user interface capable of accepting a user's various operational inputs and showing various setting screens, operational states and the like to the user.

Figure 4:
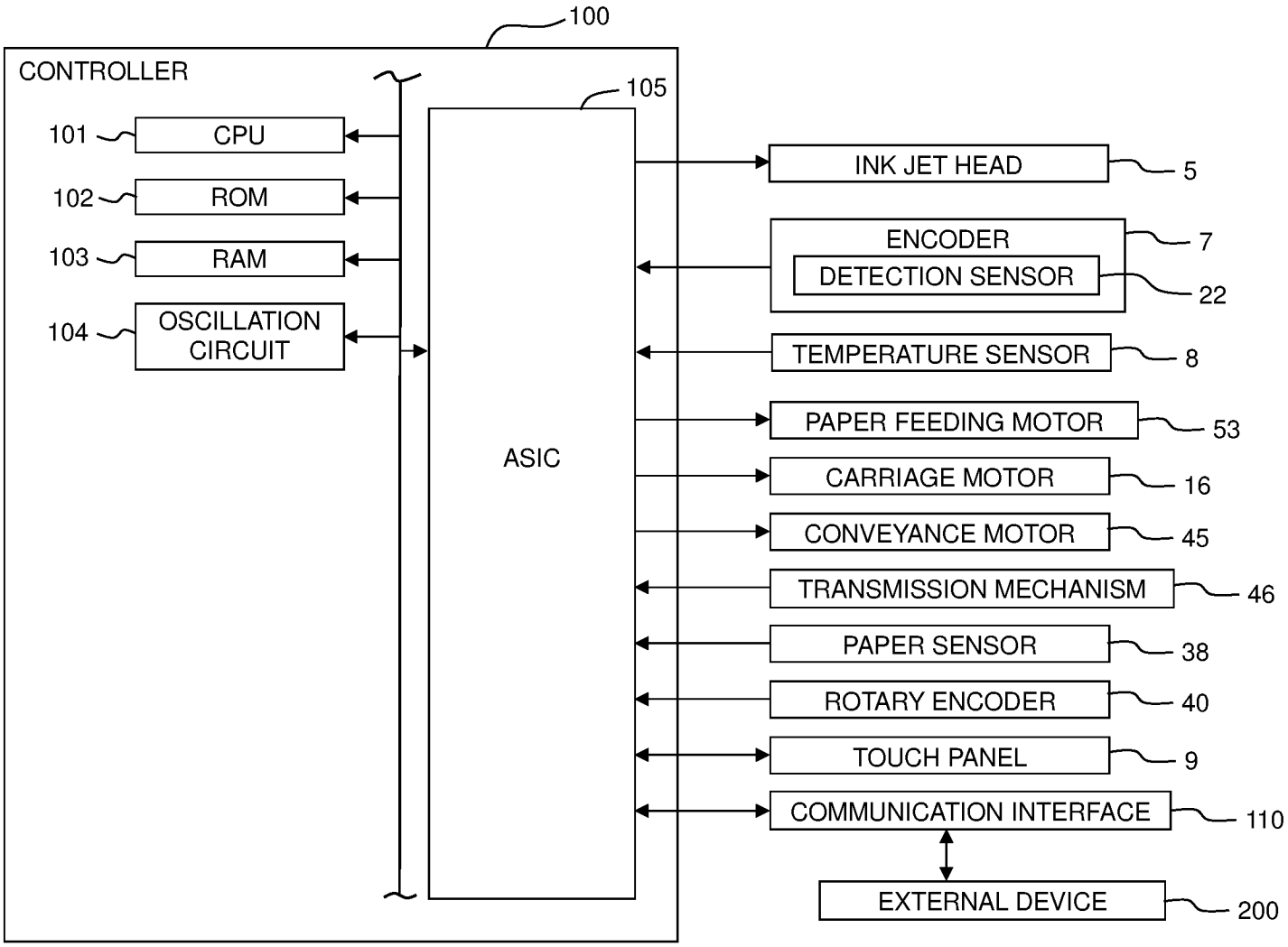
FIG. 4 is a block diagram showing an electrical configuration of the ink jet printer.

As shown in FIG. 4, the controller 100 includes a CPU (Central Processing Unit) 101, a ROM (Read Only Memory) 102, a RAM (Random Access Memory) 103, the oscillation circuit 104, an ASIC (Application Specific Integrated Circuit) 105, and the like. The ROM 102 stores programs for the CPU 101 to execute, various fixed data, and the like. The RAM 103 temporarily stores necessary data (image data and the like) for executing the programs. The oscillation circuit 104 outputs the clock signal at a predetermined frequency. The ASIC 105 is connected with various devices and driving units of the printer 1 such as the head 5, the detecting sensor 22, the carriage motor 16, the conveyance motor 45, a communication interface 110, and the like.

The controller 100 carries out various processes such as recording processes for recording image on the paper P by way of executing the programs stored in the ROM 102. Note that although the CPU plays the role of carrying out various processes in the following explanation, the ASIC may carry out the various processes alone or the CPU 101 and the ASIC 105 may cooperate to carry out the various processes. Further, the controller 100 may include a plurality of CPUs, and those processes be carried out by the plurality of CPUs in a shared manner. Further, the controller 100 may include a plurality of ASICs, and those processes be carried out by the plurality of ASICs in a shared manner.

A particular explanation will be made below about a recoding process. The CPU 101 carries out the recording process when receiving a recording instruction from an external device 200 such as a PC or the like via the communication interface 110. In particular, on receiving the recording instruction, the CPU 101 controls the pickup roller 52 and the conveyance motor 45 to convey the paper P from the paper feeding tray 51 toward the opposed area A. Then, the CPU 101 determines whether or not the paper P is positioned in the opposed area A based on the detected result and the like by the paper sensor 38. Then, if the paper P is determined as positioned in the opposed area A, then the CPU 101 starts to record the image based on the image data and the like stored in the RAM 103. In the image recording, as described earlier on, the CPU 101 records the image on the recording surface of the paper P by alternately carrying out the recording pass and the conveyance operation.

Note that through one recording pass, the CPU 101 controls the movement of the carriage 4 by a feedback control based on the deviation between a target speed, and the current carriage speed Vcr calculated on the basis of the detected result by the detecting sensor 22, such that in this recording pass, the carriage 4 may move at a constant speed which is that target speed and is the highest speed for the carriage 4. Further, in the printer 1, as the target speed for the carriage 4, it is possible to set a plurality of grades of speed. The CPU 101 sets any one of the plurality of grades of speed as the target speed in accordance with the recording instruction (such as an instruction included in the recording instruction and related to the resolution of the image printed on the paper P in the scanning direction, etc.), so as to control the carriage motor 16 such that in the recording pass, the carriage 4 may move at that constant target speed.

Here, in the one side recording mode, if the image recording is finished on the first surface of the paper P, then the CPU 101 controls the conveyance motor 45 and the transmission mechanism 46 to rotate the switchback roller pair 44 positively. By virtue of this, the paper P with the image recorded only on the first surface is discharged to a paper discharge tray 54.

On the other hand, in the both side recording mode, if the image recording is finished on the first surface of the paper P, then the CPU 101 controls the conveyance motor 45 and the transmission mechanism 46 to rotate the switchback roller pair 44 positively until the posterior end the paper P recorded with the image passes the position BP, and then to rotate the switchback roller pair 44 negatively. By virtue of this, the paper P recorded with the image is conveyed along the second conveyance path R2 and, with its two sides reversed, is conveyed again to the opposed area A. On this occasion, the second side of the paper P becomes the recording surface facing the head 5. Then, if the image recording is finished on the second surface of the paper P, then the CPU 101 controls the conveyance motor 45 and the transmission mechanism 46 to rotate the switchback roller pair 44 positively. By virtue of this, the paper P recorded with the image on the first surface and the second surface is discharged to the paper discharge tray 54.

However, if the paper P absorbs the ink, then paper deformation such as cockling, curling and the like will occur. If such paper deformation occurs, then in the succeeding recording passes, when the carriage 4 is moving, the paper P may contact with the nozzle surface 10*a* of the head 5 to give rise to a jam (the paper P is jammed). With such a jam, if the carriage 4 continues its moving, then the nozzle surface 10*a* of the head 5 will be damaged to give rise to jet defection and/or the jam will be worsened.

Figure 5A:
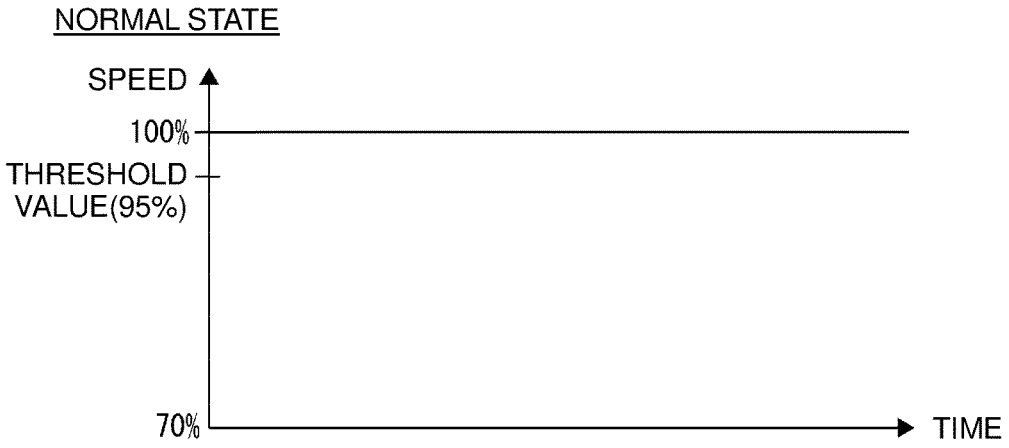
Figure 5B:
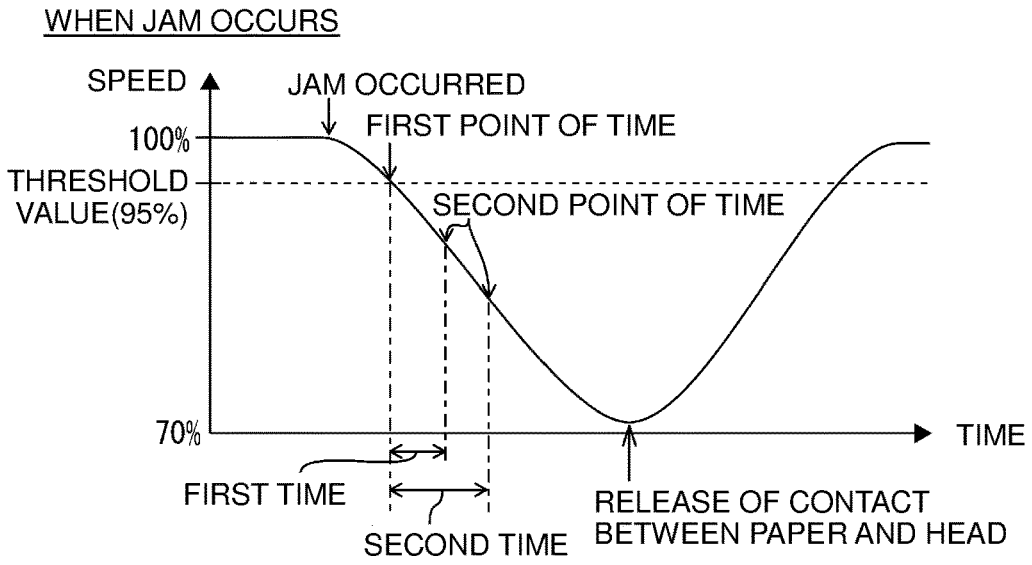
Figure 5C:
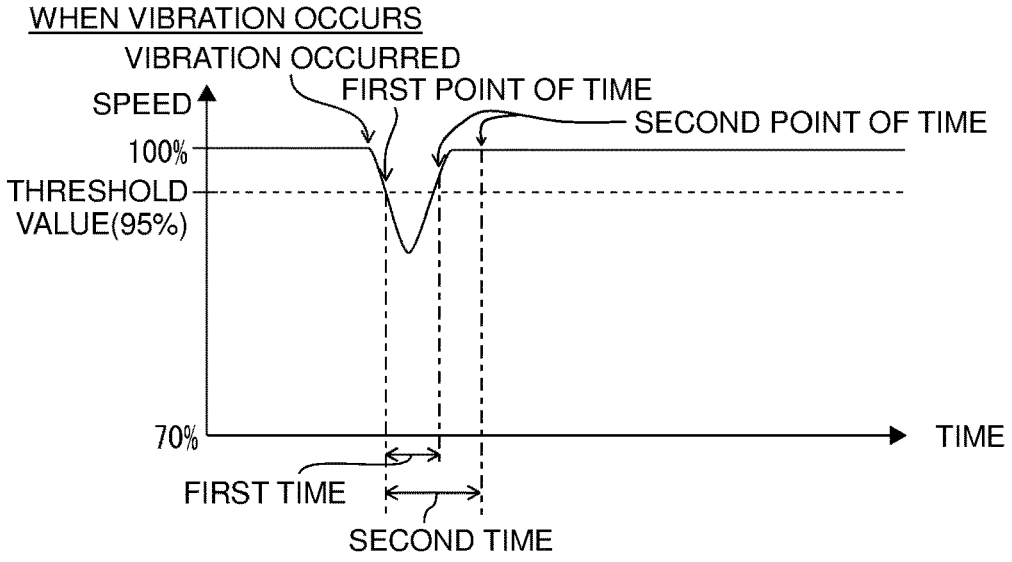

Hence, as a method for addressing this problem, when the carriage 4 is moved, carriage speeds Vcr are acquired one after another to determine whether or not a jam occurs by comparing the carriage speed Vcr to a predetermined threshold value. The details of the above method will be explained below, referring to FIGS. 5A to 5C. Note that FIGS. 5A to 5C present the carriage speed Vcr in relative values when the target speed for the carriage 4 is 100%.

In the recording pass, as mentioned earlier on, the CPU 101 controls the carriage motor 16 to move the carriage 4 at the target speed. Under this control, the carriage 4 is more or less affected by the motor's fluctuation or the like, but moves approximately at the target speed as shown in FIG. 5A. However, if a jam occurs, then as shown in FIG. 5B, due to the frictional force between the nozzle surface 10*a* and the paper P, the carriage speed Vcr decreases significantly to be below the target speed. Hence, during the recording pass, it is possible to determine that a jam has occurred if the acquired carriage speed Vcr is lower than the predetermined threshold value.

In the above manner, the CPU 101 can stop carrying out the recording pass by stopping the carriage 4 when determining that a jam has occurred so as to restrain the nozzle surface 10*a* from damage and the jam from worsening. Here, it is necessary to make the threshold value be strict or proper in accordance with the usage environment for improving the accuracy of determining whether or not a jam has occurred. That is, regardless of the usage environment, if the threshold value is set to a fixed value, then it is possible to mistakenly determine that a jam has occurred although there is no jam in reality. The details will be explained below.

If the usage environment changes in terms of surrounding temperature and the like, then the speed of the carriage 4 also changes. For example, between the carriage 4 and the guide rails 11 and 12, although a lubricant agent such as grease or the like is interposed for lowering the sliding load on the carriage 4, the hardness of the lubricant agent changes with the surrounding temperature. Therefore, if the surrounding temperature changes, then the sliding load on the carriage 4 changes and thus the speed of the carriage 4 also changes. Further, the motors such as the carriage motor 16 and the like change in output current and torque if the surrounding temperature changes. Hence, if the surrounding temperature changes, then the carriage 4 changes in speed stability.

Further, the scale 21 may become abnormal because of the ink dirties some parts thereof. For example, if a jam has occurred, the user will remove the jammed recording paper but, in the course of the removal, the ink may be attached to the scale 21 and dirty the same. In this manner, if the scale 21 becomes abnormal such as some dirt being attached thereto or the like, then it is difficult for the detecting sensor 22 to correctly read out the non-transmission area 21*b* on the scale 21. As a result, the carriage speed Vcr acquired on the basis of the detected result by the detecting sensor 22 may become lower than the actual speed.

Due to the above causes, if the threshold value is a fixed value, then the recording pass in performance may be suspended unnecessarily because the carriage speed Vcr acquired on the basis of the detected result by the detecting sensor 22 decreases to be below the threshold value although there is no jam arising in reality.

Hence, in the first embodiment, the above threshold value is set by a threshold value setting process performed right before the recording process. In particular, in the threshold value setting process, with the paper P being not present in the opposed area A, the CPU 101 first controls the carriage motor 16 to move the carriage 4 at the constant speed which is the same as the target speed for carrying out the recording pass. Then, the CPU 101 acquires the carriage speed Vcr a number of times during the moving of the carriage 4. Then, the CPU 101 sets the threshold value at such a value as slower than the slowest carriage speed Vcr by a predetermined amount among the plurality of carriage speeds Vcr acquired during the moving of the carriage 4. For example, the threshold value is set at a value being a small percent less than the slowest carriage speed Vcr. In the above manner, it is possible to set an appropriate threshold value in accordance with the current usage environment.

However, the carriage speed Vcr may decrease due to other causes than paper jams. The following explanation is made about some vibration as an example of another cause than the paper jams. If some kind of vibration is applied temporarily to the printer 1 from the outside, then as shown in FIG. 5C, the carriage speed Vcr decreases. On this occasion, depending on the type of vibration, the carriage speed Vcr may decrease to be below the threshold value. In such cases, although no jam has occurred actually, the CPU 101 will mistakenly determine that there is a jam. As a result, because the recording pass is suspended unnecessarily, the usability the printer 1 is degraded.

Hence, the present inventors have found out the aspect of change in the carriage speed Vcr after the point of time of becoming lower than the threshold value, between the time when the carriage speed Vcr becomes lower than the threshold value due to a jam and the time when the carriage speed Vcr becomes lower than the threshold value due to a vibration from the outside.

In particular, if a jam occurs, then as shown in FIG. 5B, the carriage speed Vcr decreases comparatively gradually until the contact between the paper P and the head 5 is released. Then, if the contact between the paper P and the head 5 is released, then the carriage speed Vcr is restored to the target speed. Therefore, it takes a comparatively long time to restore the carriage speed Vcr up to that threshold value or more if the carriage speed Vcr decreases to be lower than the threshold value due to a jam.

On the other hand, if some vibration is applied from the outside, then as shown in FIG. 5C, the carriage speed Vcr decreases comparatively rapidly and then is restored to the target speed over a short time. Therefore, if the carriage speed Vcr decreases to be lower than the threshold value due to the vibration from the outside, then it takes a comparatively short time for the carriage speed Vcr to be restored up to that threshold value or more.

In view of the above phenomenon, in the first embodiment, the CPU 101 does not immediately determine that a jam has occurred at the time (to be referred below to as a first point of time) of determining that the carriage speed Vcr decreases to be lower than the threshold value in the recording pass, but continues carrying out the recording pass. Then, after a predetermined time has elapsed since the first point of time, at a second point of time in the recording pass, the CPU 101 refers to the carriage speed Vcr, for determining whether or not a jam has occurred. In particular, the CPU 101 determines that a jam has occurred if the carriage speed Vcr is lower than the threshold value at the second point of time, or determines that no jam has occurred if the carriage speed Vcr is equal to or higher than the threshold value.

By virtue of this, even when the vibration is applied from the outside to cause the carriage speed Vcr to be lower than the threshold value, if the carriage speed Vcr increases to be equal to or higher than the threshold value before the second point of time, then the CPU 101 can determine that no jam has occurred. As a result, it is possible to reduce the possibility that the recording pass is unnecessarily suspended.

However, there is a difference in the restoration time from the decrease of carriage speed Vcr to be lower than the threshold value to the restored threshold value or more, depending on the type of vibration applied to the printer 1. For example, with the same vibration time, if the vibration with a large amplitude is applied, then the restoration time becomes longer in comparison with the vibration with a small amplitude. Therefore, when a vibration is applied, in order to increase the types of the vibration for being determinable as no jam, within a range of unexceeding the minimum restoration time predicted when a jam has occurred, it is preferable to elongate the predetermined time from the first point of time to the second point of time. By virtue of this, it is possible to improve the accuracy of determining whether or not a jam has occurred. On the other hand, the longer the predetermined time, the later the time of determining whether or not a jam has occurred. As a result, from the point of time when a jam occurs, it takes a longer time to suspend the recording pass, such that the head 5 is liable to damage and the jam to worsening.

Then, the CPU 101 takes the predetermined time as a first time under the condition for a jam to be more likely to occur, and adjusts the predetermined time to a second time longer than the first standby time under the condition for a jam to be less likely to occur. In particular, the higher the surrounding temperature, the more likely the paper P to deform after the ink lands thereon. As a result, a jam is more likely to occur. Hence, in the first embodiment, if the temperature measured by the temperature sensor 8 is equal to or higher than a threshold temperature, then the predetermined time is taken as the first time whereas if the temperature is lower than the threshold temperature, then the predetermined time is taken as the second time.

By virtue of this, under the condition for a jam to be more likely to occur, because the predetermined time is short, it is possible to determine the jam at an early time. As a result, it is possible to shorten the time from the point of the jam occurrence to the suspension of the recording pass. On the other hand, under the condition for a jam to be less likely to occur, because the predetermined time is long, it is possible to improve the accuracy of determining whether or not a jam has occurred or, in other words, whether or not the speed decreases due to the jam. As a result, it is possible to lower the possibility of unnecessary suspension of the recording pass.

Figure 6A:
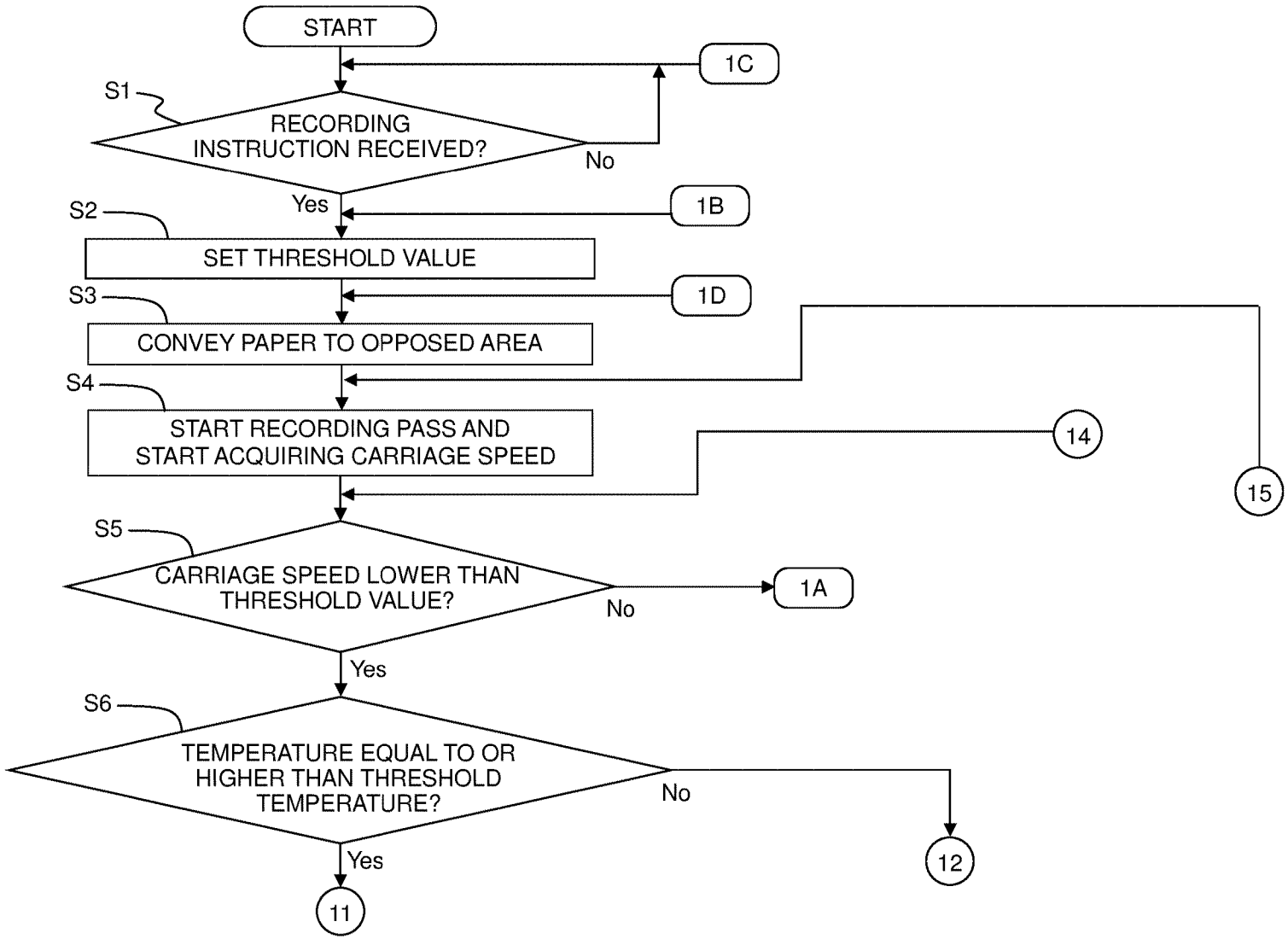
FIGS. 6A to 6C are a flow chart showing an operation of the ink jet printer.
Figure 6B:
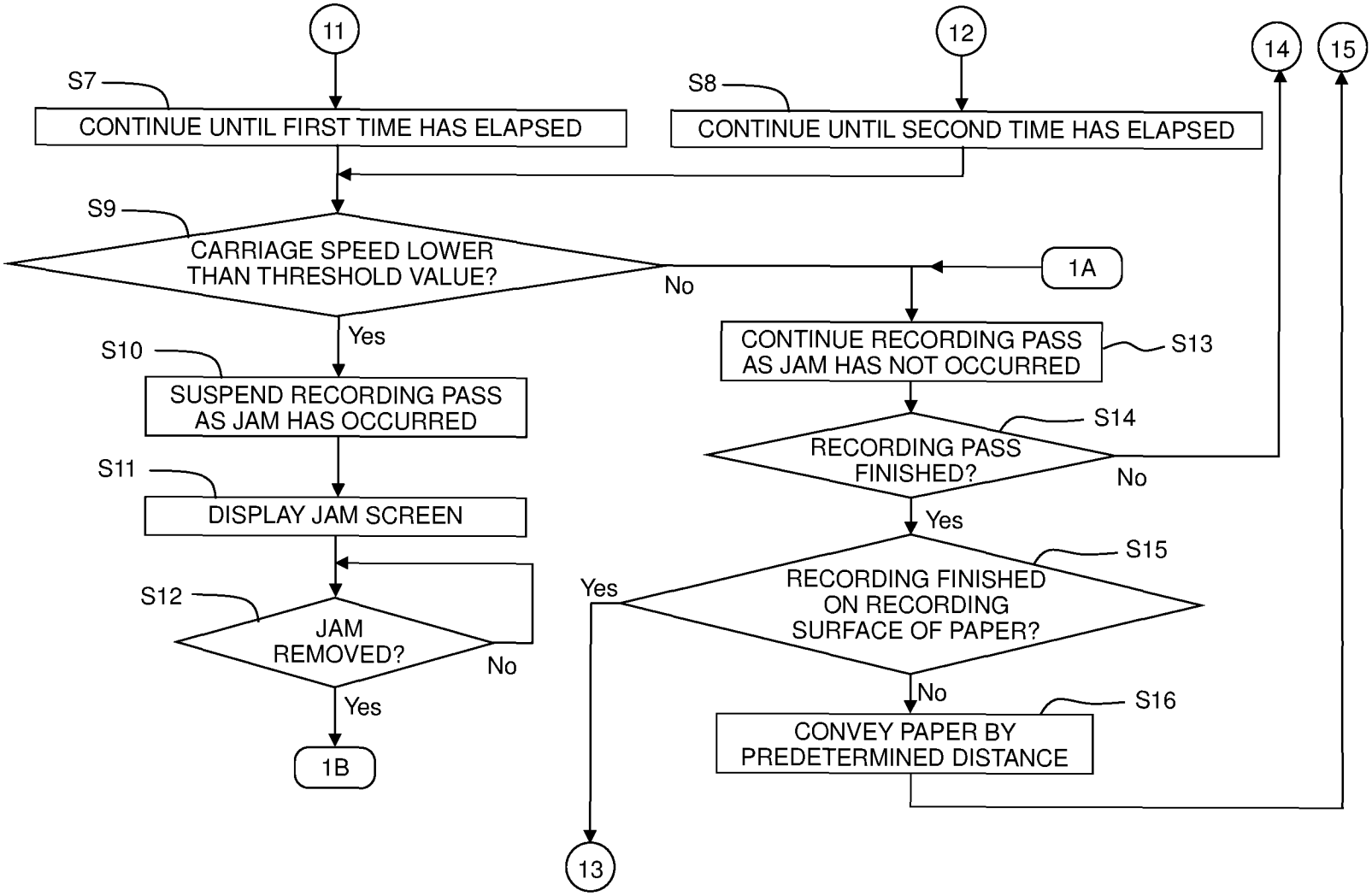
Figure 6C:
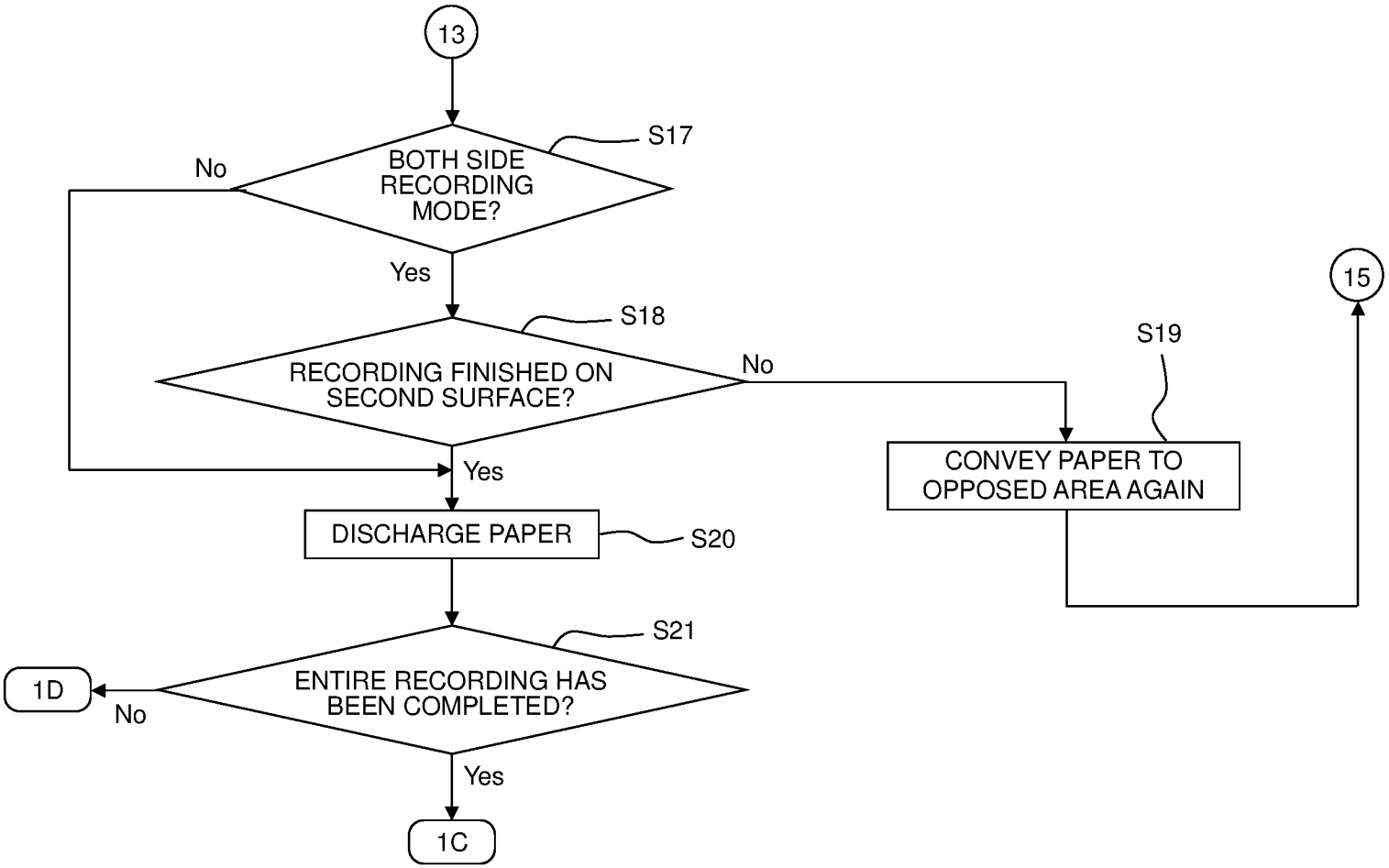

Referring to FIGS. 6A to 6C, a series of operations of the printer 1 will be explained below. Note that in the beginning of the operation flow in FIGS. 6A to 6C, the paper P is not present on the feeding path F, the first conveyance path R1 and the second conveyance path R2.

As shown in FIG. 6A, the CPU 101 receives a recording instruction from the external device 200 or the like (S1: Yes), and carries out the threshold value setting process (S2). In particular, the CPU 101 controls the carriage motor 16 to move the carriage 4 at the constant speed which is the same as the target speed for carrying out the recording pass. Then, the CPU 101 acquires the carriage speed Vcr a number of times on the basis of the detected result by the detecting sensor 22 during the moving of the carriage 4. Then, the CPU 101 sets the threshold value to be slower than the slowest carriage speed Vcr by the predetermined amount among the plurality of carriage speeds Vcr acquired during the moving of the carriage 4.

Next, the CPU 101 controls the pickup roller 52, the conveyance motor 45 and the like to convey the paper P on the paper feeding tray 51 up to the opposed area A (S3). Then, the CPU 101 starts one recording pass (S4). That is, the CPU 101 controls the carriage motor 16 to start moving the carriage 4 in the scanning direction, and controls the head 5 to start jetting the ink from the nozzles 10. In controlling the carriage motor 16, based on the detected result by the detecting sensor 22, the carriage speeds Vcr are acquired one after another.

Next, the CPU 101 determines whether or not the carriage speed Vcr acquired at the current time is lower than the threshold value set in the process of S2 (S5). Then, if the carriage speed Vcr is determined as equal to or higher than the threshold value (S5: No), then the CPU 101 determines that no jam has occurred so as to continue carrying out the recording pass (S13), and then the process proceeds to S14. On the other hand, if the carriage speed Vcr is determined as lower than the threshold value (S5: Yes), then the CPU 101 determines whether or not the temperature measured by the temperature sensor 8 is equal to or higher than the threshold value temperature (S6). If the temperature is determined as equal to or higher than the threshold value temperature (S6: Yes), then the CPU 101 continues to move the carriage 4 from the processing point of the step S5 (the first point of time) until the first time has elapsed (S7), and then the process proceeds to the step S9. On the other hand, if the temperature is determined as lower than the threshold value temperature (S6: No), then the CPU 101 continues to move the carriage 4 from the processing point of the step S5 until the second time has elapsed (S8), and then the process proceeds to the step S9. Note that in carrying out the processes of S6 to S9, the recording pass is continuously carried out while the carriage 4 is moving in the scanning direction.

In the process of S9, the CPU 101 determines whether or not the carriage speed Vcr acquired at the current point (the second point of time) is lower than the threshold value set in the process of S2. If the carriage speed Vcr is determined as lower than the threshold value (S9: Yes), then the CPU 101 determines that a jam has occurred and controls the carriage motor 16 to stop the carriage 4 and suspend the recording pass (S10). Then, the CPU 101 causes the touch panel 9 to display a screen indicating that a jam has occurred (S11). Then, the user removes the jammed paper. Then, via the touch panel 9, on receiving the input from the user indicating that the removal is finished and the jam is resolved (S12: Yes), the CPU 101 returns the process to the step S2 to carry out the threshold value setting process again for it is possible for some new dirt to come onto the scale 21 during the removal of the jammed paper.

In the process of S9, if the carriage speed Vcr is determined as equal to or higher than the threshold value (S9: No), then the CPU 101 determines that no jam has occurred and continues the recording pass (S13), and then the process proceeds to the step S14.

In the process of S14, the CPU 101 determines whether or not the recording pass (one pass of the image recording) is finished. If the recording pass is not finished (S14: No), then the recording pass should continue such that the process returns to the step S5. On the other hand, if it is determined that the recording pass is finished (S14: Yes), then the CPU 101 determines whether or not the image recording on the recording surface of the paper P is finished (S15). If the image recording on the recording surface is not finished (S15: No), then the CPU 101 controls the conveyance motor 45 to convey the paper P frontward through a predetermined distance (S16), and then the process turns to the step S4 for carrying out the next recording pass. On the other hand, if the image recording on the recording surface is determined as finished (S15: Yes), then the CPU 101 determines whether the recording mode is the both side recording mode or the one side recording mode (S17). If the recording mode is determined as the both side recording mode (S17: Yes), then the CPU 101 determines whether or not the image recording on the second surface of the paper P is finished (S18). If the image recording on the second surface is not finished (S18: No), then the CPU 101 controls the conveyance motor 45 and the transmission mechanism 46 to convey the paper P finished with the image recording on the first surface again to the opposed area A via the second conveyance path R2 for carrying out the image recording on the second surface (S19), and then the process turns to the step S4.

If the recording mode is determined as the one side recording mode in the process of S17 (S17: No) or the image recording on the second surface is determined as finished in the process of S18 (S18: Yes), then the CPU 101 controls the conveyance motor 45 to discharge the paper P finished with the image recording to the paper discharge tray 54 (S20). Then, the CPU 101 determines whether or not the entire image recording according to the received recording instruction is finished (S21). If the entire image recording is determined as finished (S21: Yes), then the process returns to the step S1. On the other hand, if the entire image recording is determined as not finished (S21: No), then the process returns to the step S3 for carrying out the image recording on the next paper P.

Hereinabove, according to the first embodiment, at the first point of time where the carriage speed Vcr is determined as lower than the threshold value, without determining whether to suspend or to continue the recording pass, the determination is made by referring to the carriage speed Vcr acquired at the second point of time during the recording pass. By virtue of this, because it is possible to raise the accuracy of determining whether or not a jam has occurred, it is possible to lower the possibility of damaging the head 5 while reducing the possibility of unnecessary suspension of the recording pass.

Further, under the condition of a jam being more likely to occur due to high temperature, it is possible to carry out an early determination of the jam by virtue of shortening the predetermined time. As a result, from the point of a jam arising, because it is possible to shorten the time till the suspension of the recording pass, it is possible to lower the possibility of damaging the head 5. On the other hand, if the temperature is low, then by elongating the predetermined time, it is possible to improve the accuracy of determining whether or not a jam has occurred or, in other words, whether or not the speed decreases due to the jam. As a result, it is possible to lower the possibility of unnecessary suspension of the recording pass. In the first embodiment, the temperature measured by the temperature sensor 8 is an example of the predetermined condition of the present teaching.

Next, modified embodiments will be explained on the basis of the first embodiment. In the first embodiment, the predetermined time is adjusted under the "predetermined condition" being the temperature measured by the temperature sensor 8. However, without being limited to that, a few modified embodiments (first to fourth modified embodiments) will be explained below.

Figure 7A:
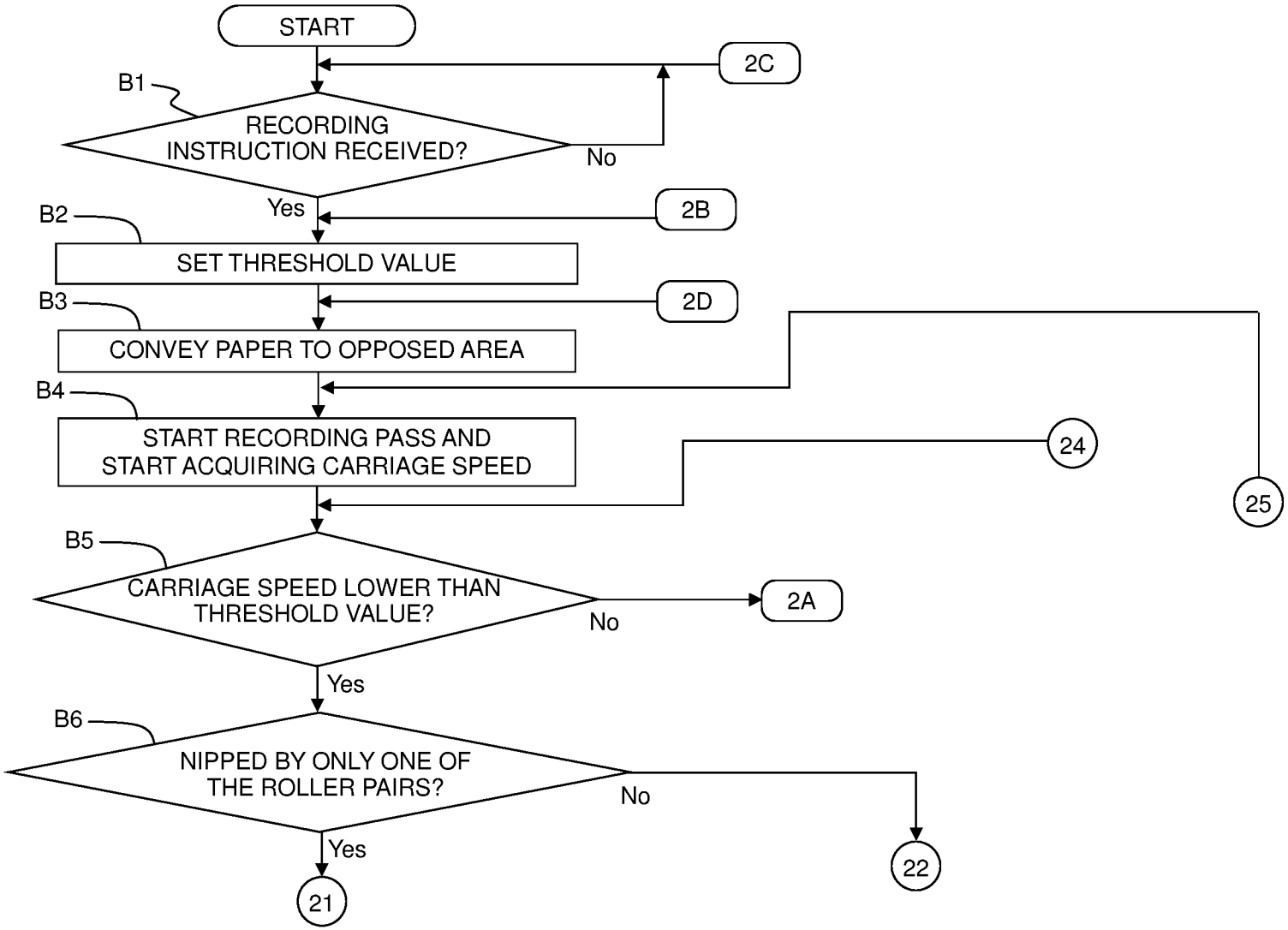
FIGS. 7A to 7C are a flow chart showing an operation of the ink jet printer according to a first modified embodiment.
Figure 7B:
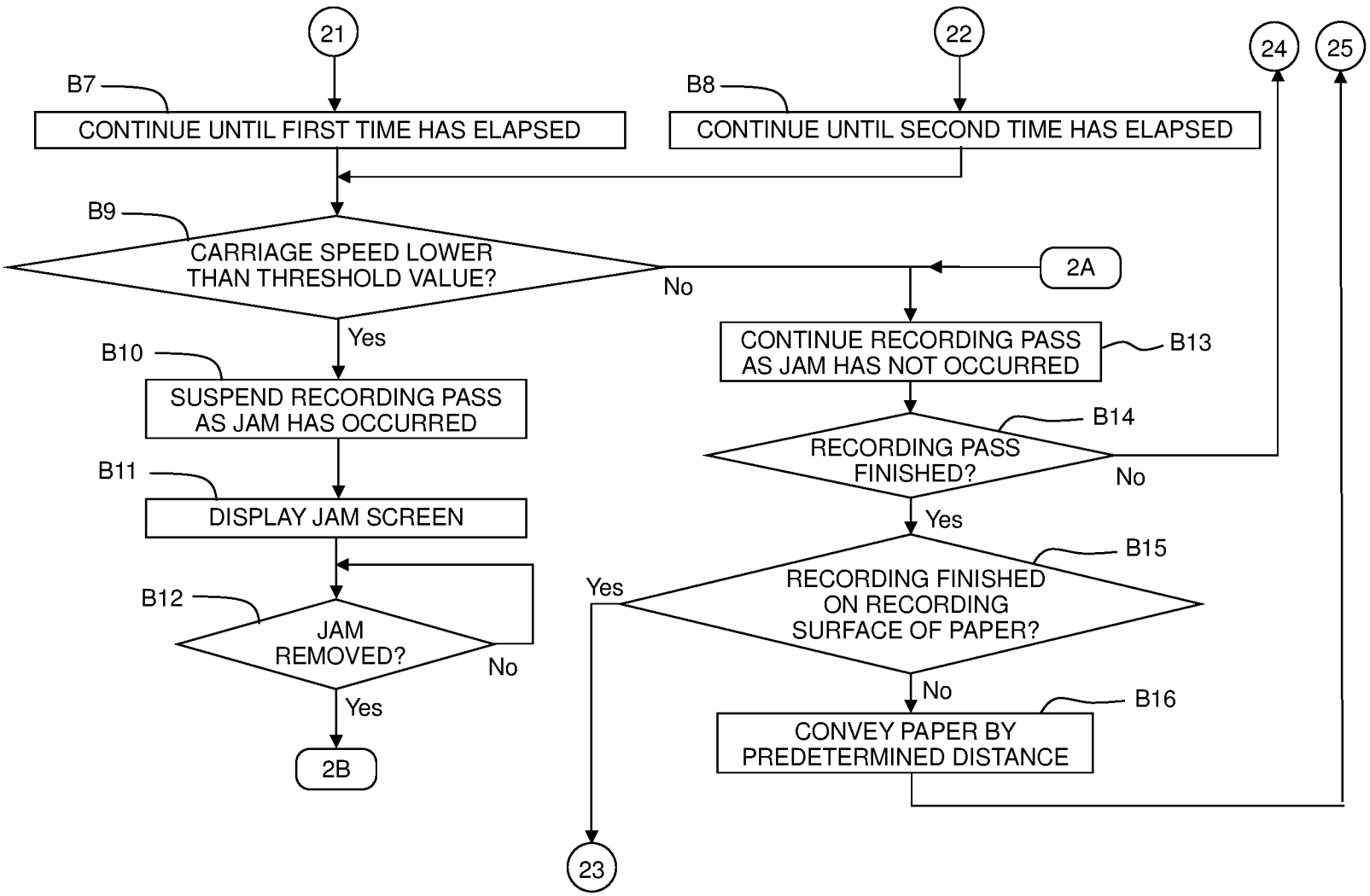
Figure 7C:
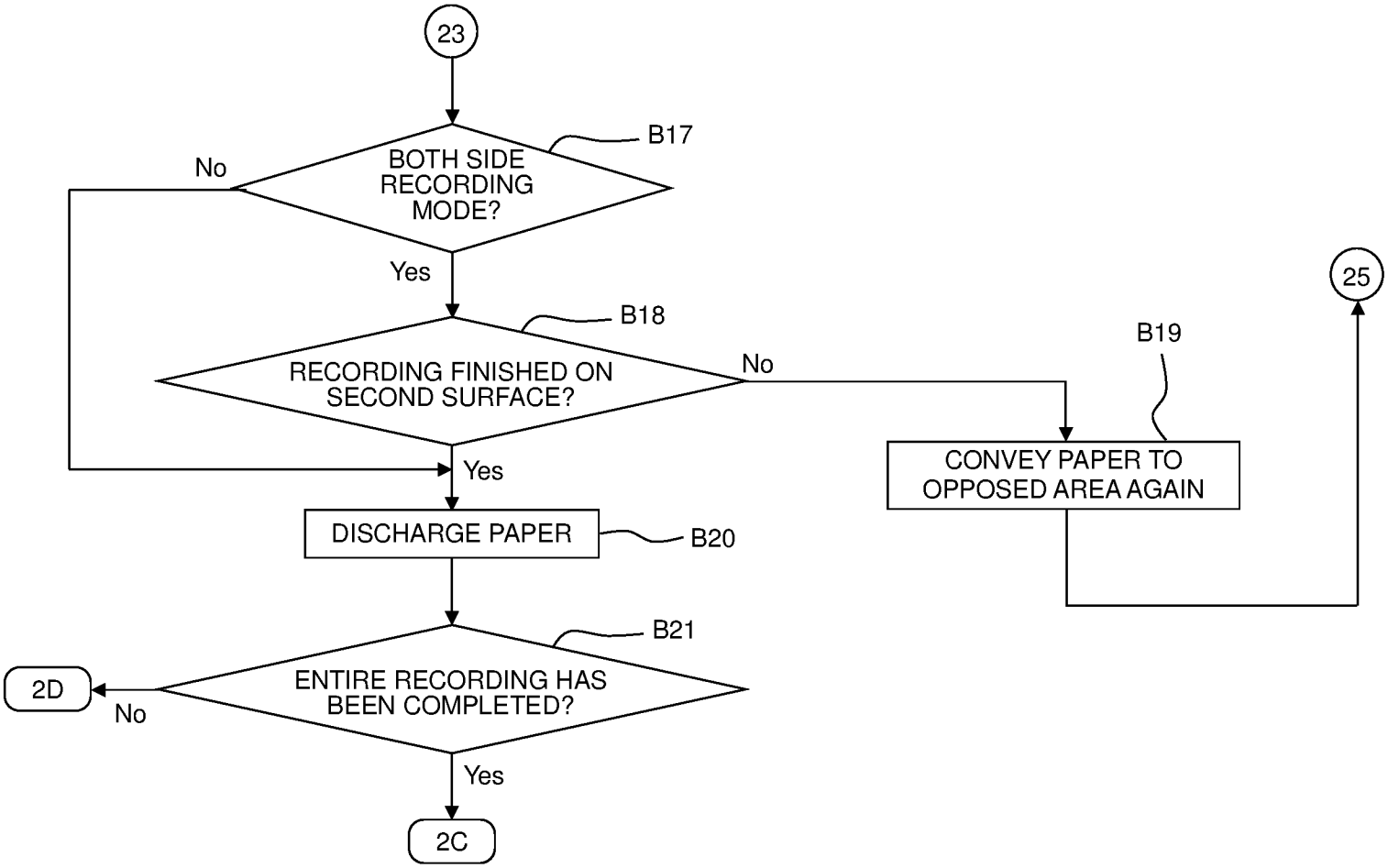

In the first modified embodiment, as shown in FIG. 7A, the CPU 101 carries out processes of B1 to B5 in the same manner as the processes of S1 to S5 described earlier on. Then, in the process of B5, if the carriage speed Vcr is determined as lower than the threshold value (B5: Yes), then the CPU 101 determines whether the paper P is nipped by both the conveyance roller pairs 42 and 43 or by only one of the conveyance roller pairs 42 and 43 (B6).

Here, in the image recording, in the first recording pass, the paper P is nipped by the conveyance roller pair 42 alone. Then, the paper P is nipped by both the conveyance roller pairs 42 and 43, and conveyed through at least one conveyance operation. Further, the paper P is nipped by conveyance roller pair 43 alone and conveyed through at least one conveyance operation. It is possible to determine which of the above three states the paper P stays in by, for example, the size of the paper P (the length along the conveyance direction) and the nth recording pass.

Then, if the paper P is determined as nipped by only one of the conveyance roller pairs 42 and 43 (B6: Yes), then the CPU 101 continues to move the carriage 4 from the processing point of B5 (the first point of time) until the first time has elapsed (B7), and then the process proceeds to the step B9. On the other hand, if the paper P is determined as nipped by both the conveyance roller pairs 42 and 43 (B6: No), then the CPU 101 continues to move the carriage 4 from the processing point of B5 until the second time has elapsed (B8), and then the process proceeds to the step B9. Then, the CPU 101 carries out the processes of B9 to B21 in the same manner as the processes of S9 to S21.

In the above manner, in the first modified embodiment, if the paper P is nipped by only one of the conveyance roller pairs 42 and 43, then the predetermined time is adjusted shorter than that when the paper P is nipped by both of the roller pairs.

Here, with the paper P being nipped by only one of the conveyance roller pairs 42 and 43, the paper P is more likely to deform and a jam is more likely to occur than the paper P being nipped by both the conveyance roller pairs 42 and 43. Hence, in the first modified embodiment, when the paper P is nipped by only one of the conveyance roller pairs 42 and 43, the predetermined time is shortened. By virtue of this, because it is possible to determine a jam at an early time, it is possible to shorten the time from the point of the jam arising to the suspension of the recording pass. On the other hand, when the paper P is nipped by both the conveyance roller pairs 42 and 43, by elongating the predetermined time, it is possible to improve the accuracy of determining whether or not a jam has occurred. In the first modified embodiment, the state of the paper P being nipped by the conveyance roller pairs 42 and 43 for conveyance is an example of the predetermined condition of the present teaching.

Figure 8A:
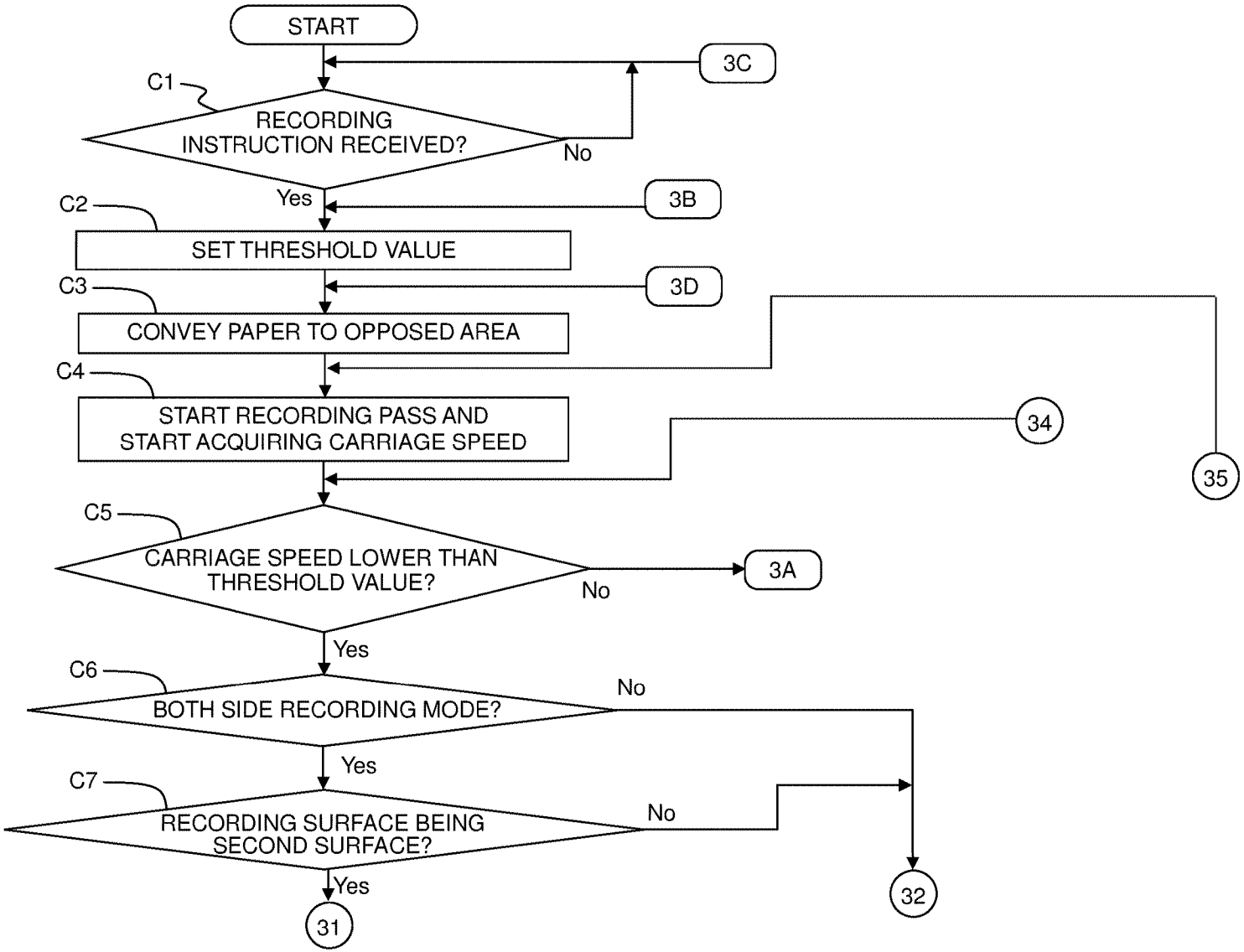
FIGS. 8A to 8C are a flow chart showing an operation of the ink jet printer according to a second modified embodiment.
Figure 8B:
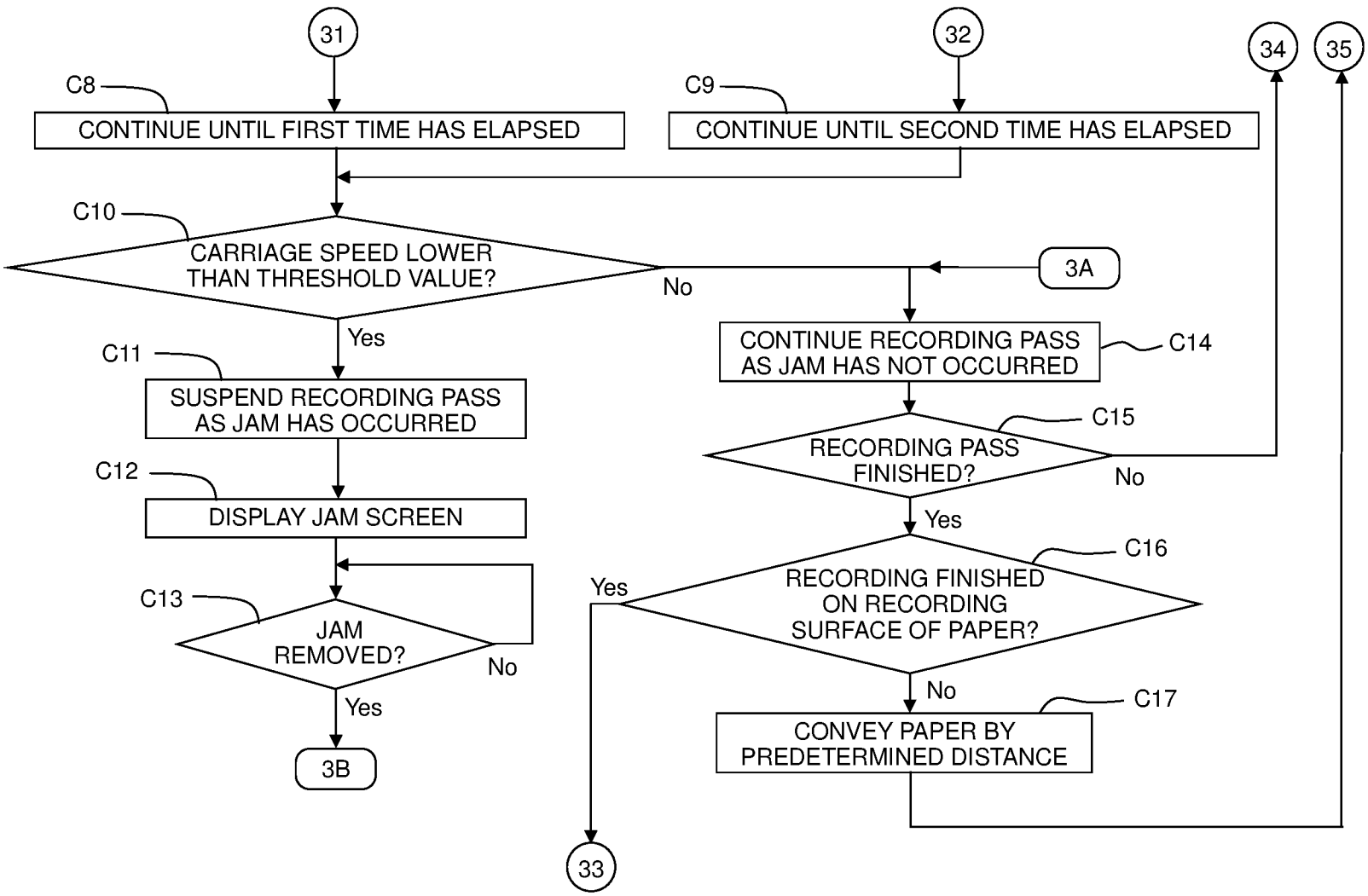
Figure 8C:
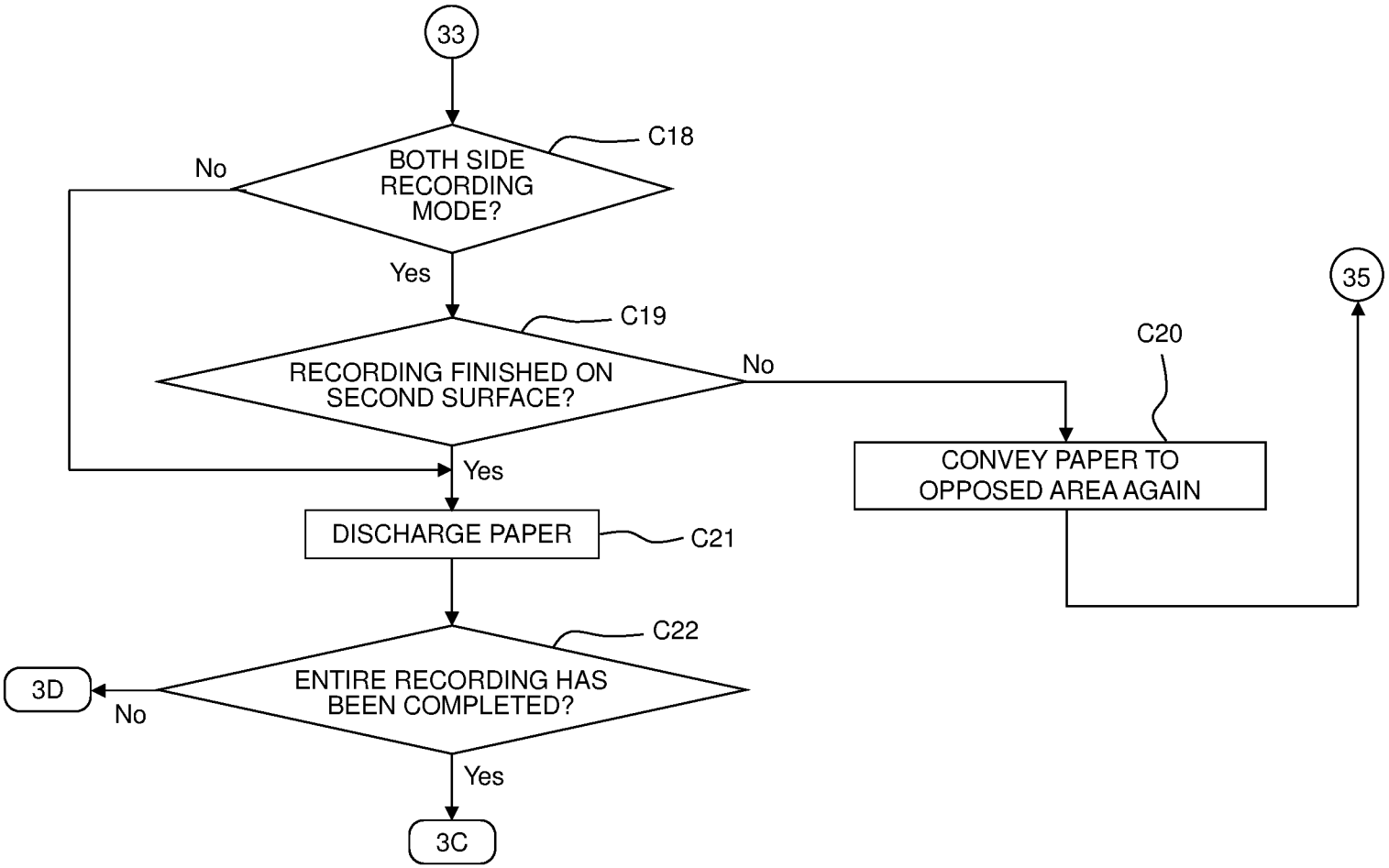

Next, the second modified embodiment will be explained. In the second modified embodiment, as shown in FIG. 8A, the CPU 101 carries out processes of C1 to C5 in the same manner as the processes of S1 to S5 described earlier on. Then, in the process of C5, if the carriage speed Vcr is determined as lower than the threshold value (S5: Yes), then the CPU 101 determines whether the recording mode is the both side recording mode or the one side recording mode (C6). If the recording mode is determined as the both side recording mode (C6: Yes), then the CPU 101 determines whether or not the recording surface is the second surface of the paper P (C7). Then, if the recording surface is the second surface (C7: Yes), then the CPU 101 continues to move the carriage 4 from the processing point of the step C5 (the first point of time) until the first time has elapsed (C8), and then the process proceeds to the step C10. On the other hand, if the recording mode is determined in the process of C6 as the one side recording mode (C6: No) or if the recording surface is determined in the process of C7 as the first surface of the paper P (C7: No), then the CPU 101 continues to move the carriage 4 from the processing point of the step C5 until the second time has elapsed (C9), and then the process proceeds to the step C10. Thereafter, the CPU 101 carries out processes of C10 to C22 in the same manner as the processes of S9 to S21.

In the above manner, in the second modified embodiment, when the recording mode is the both side recording mode and the recording surface is the second surface, the predetermined time is adjusted shorter than when the recording mode is the one side recording mode or the recording surface is the first surface.

Here, when the recording surface is the second surface in the both side recording mode, the image is recorded on the first surface where the ink lands on the paper P; therefore, there is a high possibility for the paper P to deform, and a jam is more likely to occur. Hence, if the recording mode is the both side recording mode and the recording surface of the paper P is the second surface, then the predetermined time is shortened. By virtue of this, because it is possible to determine a jam at an early time, it is possible to shorten the time from the point of the jam arising to the suspension of the recording pass. On the other hand, if the recording mode is the one side recording mode or the recording surface is the first surface, then by elongating the predetermined time, it is possible to improve the accuracy of determining whether or not a jam has occurred. In the second modified embodiment, the recording surface of the paper P is an example of the predetermined condition of the present teaching.

Figure 9A:
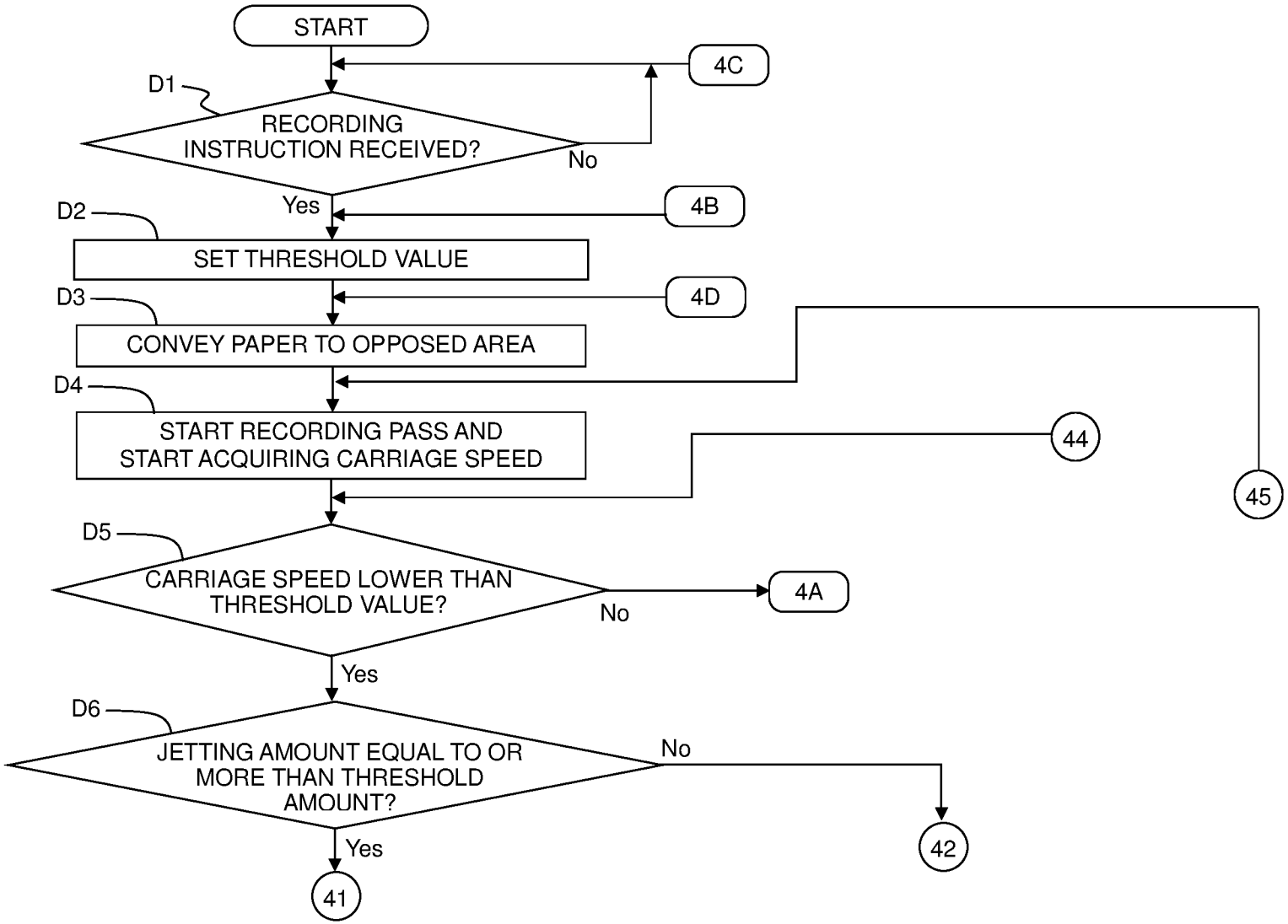
FIGS. 9A to 9C are a flow chart showing an operation of the ink jet printer according to a third modified embodiment.
Figure 9B:
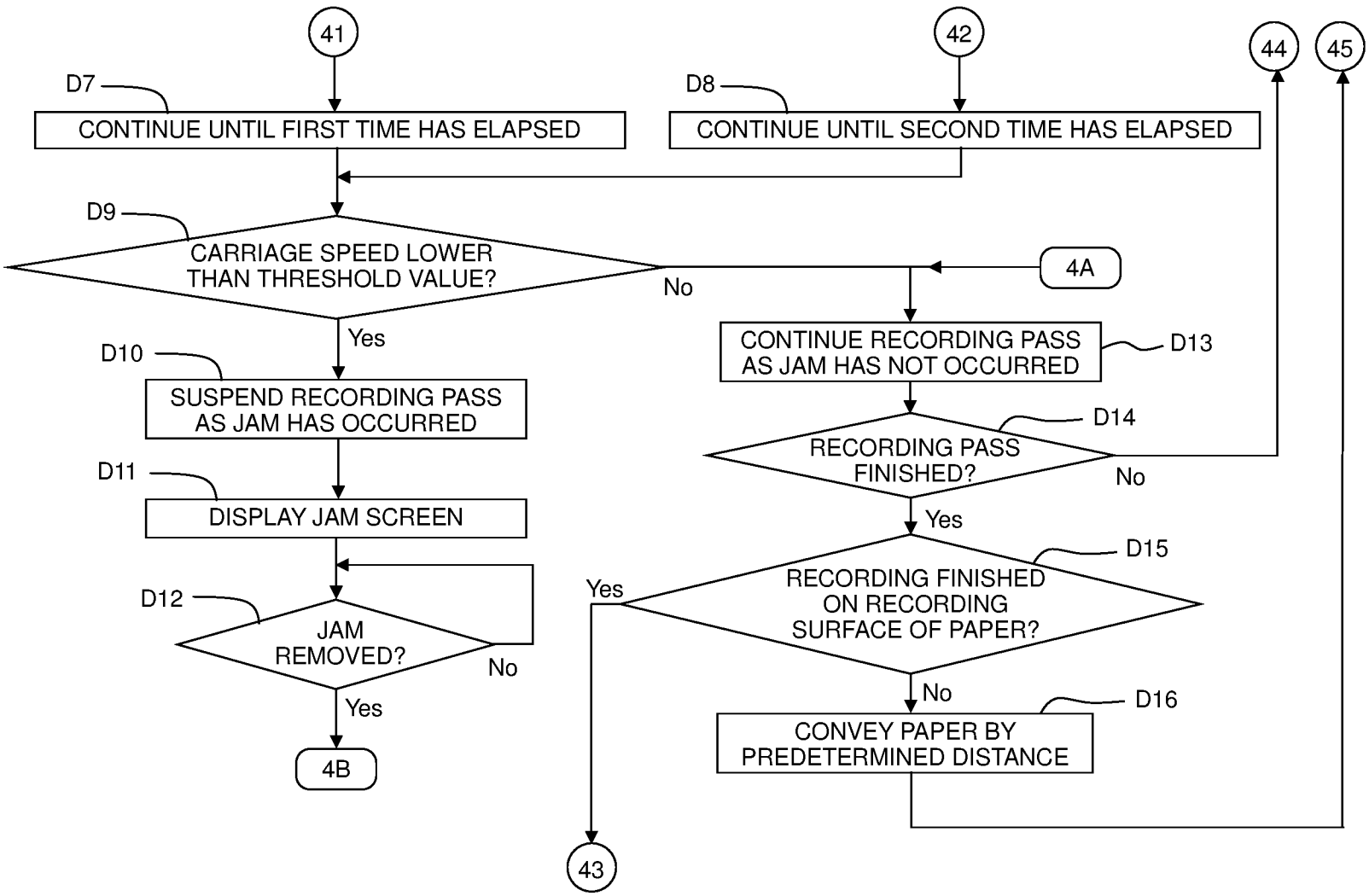
Figure 9C:
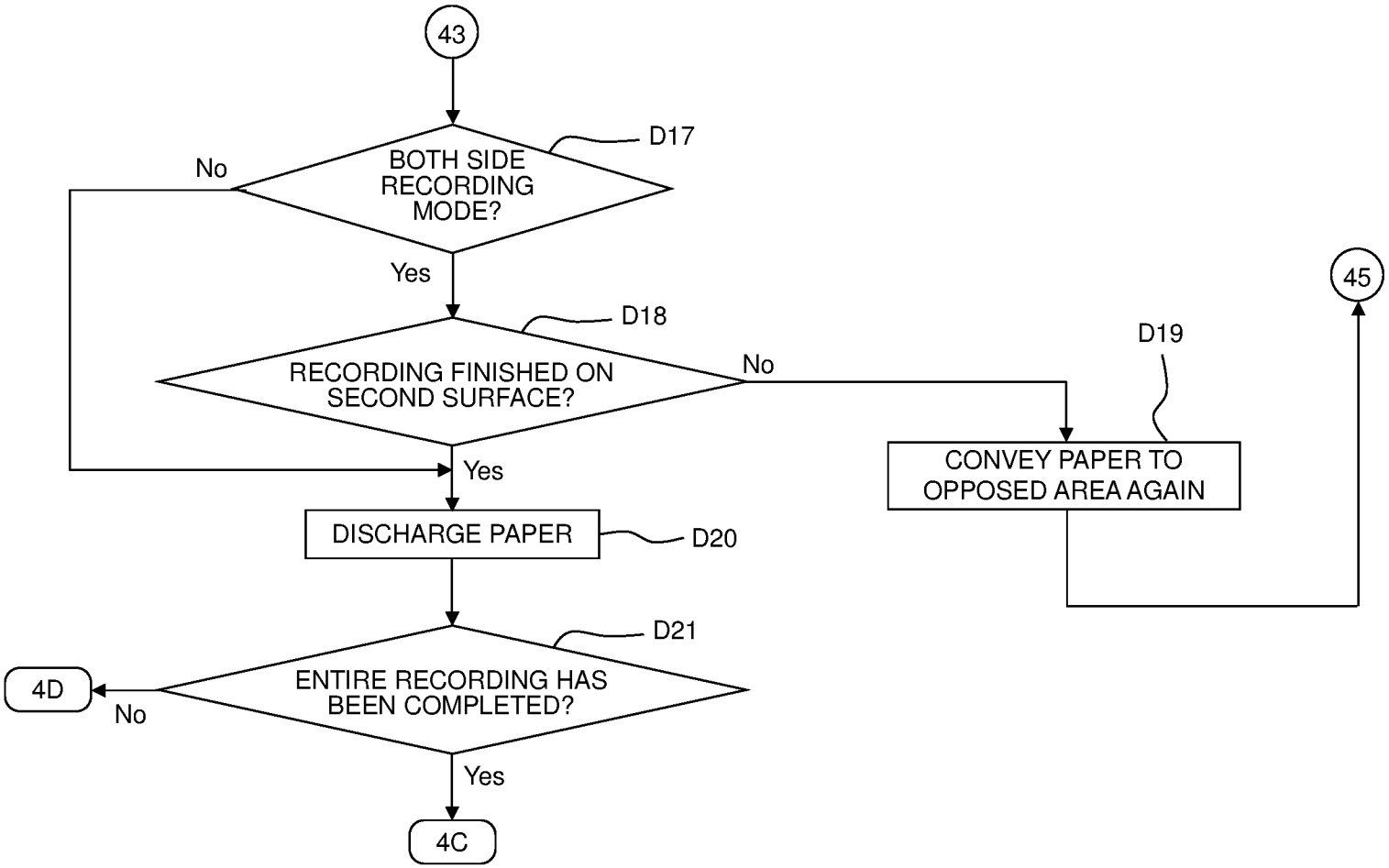

Next, the third modified embodiment will be explained. In the third modified embodiment, as shown in FIG. 9A, the CPU 101 carries out processes of D1 to D5 in the same manner as the processes of S1 to S5 described earlier on. Then, in the process of D5, if the carriage speed Vcr is determined as lower than the threshold value (D5: Yes), then the CPU 101 determines whether or not the ink jetting amount jetted from the head 5 is equal to or more than a threshold quantity from the beginning of the current image recording on the paper P to the processing point of D5 (the first point of time) (D6). Note that it is possible to calculate the jetting amount from the image data for recording, the drive condition for the actuator of the head 5, and the like.

Then, if the jetting amount is determined as equal to or more than the threshold quantity (D6: Yes), then the CPU 101 continues to move the carriage 4 from the processing point of D5 (the first point of time) until the first time has elapsed (D7), and then the process proceeds to the step D9. On the other hand, if the jetting amount is determined as lower than the threshold quantity (D6: No), then the CPU 101 continues to move the carriage 4 from the processing point of D5 until the second time has elapsed (D8), and then the process proceeds to the step D9. Then, the CPU 101 carries out processes of D9 to D21 in the same manner as the processes of S9 to S21.

In the above manner, in the third modified embodiment, the more the jetting amount jetted from the head 5 up to the first point of time, the shorter the predetermined time is adjusted. Here, the more the ink quantity landing on the paper P, the higher the possibility for the paper P to deform, and the more a jam is likely to occur. Hence, in the third modified embodiment, up to the processing point of D5 (the first point of time), if the ink jetting amount jetted from the head 5 is equal to or more than the threshold quantity, then the predetermined time is shortened. By virtue of this, because it is possible to determine a jam at an early time, it is possible to shorten the time from the point of the jam arising to the suspension of the recording pass. On the other hand, up to the processing point of D5 (the first point of time), if the ink jetting amount jetted from the head 5 is lower than the threshold quantity, then by elongating the predetermined time, it is possible to improve the accuracy of determining whether or not a jam has occurred. In the third modified embodiment, the ink jetting amount jetted from the head 5 up to the first point of time is an example of the predetermined condition of the present teaching.

Figure 10A:
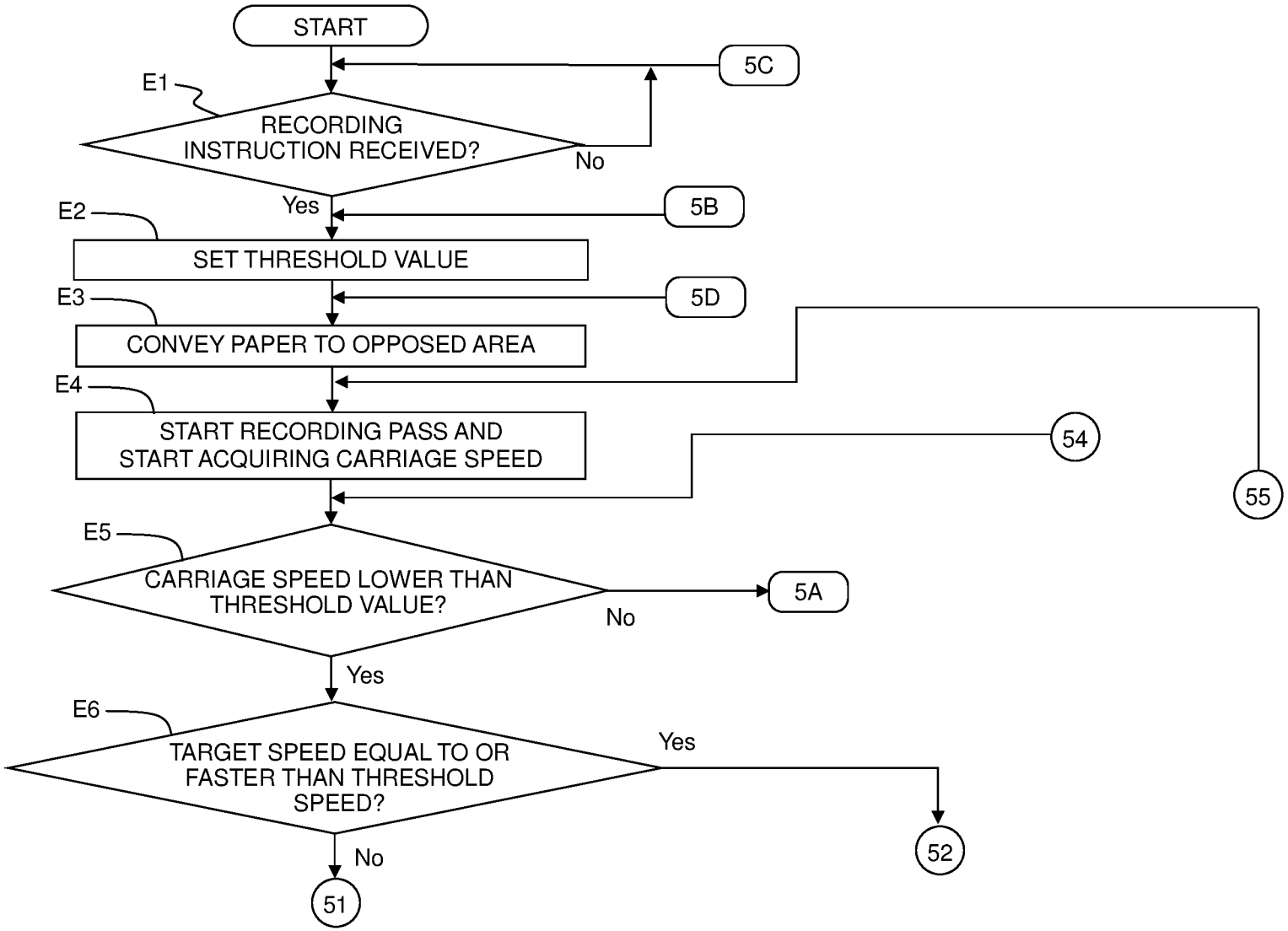
FIGS. 10A to 10C are a flow chart showing an operation of the ink jet printer according to a fourth modified embodiment.
Figure 10B:
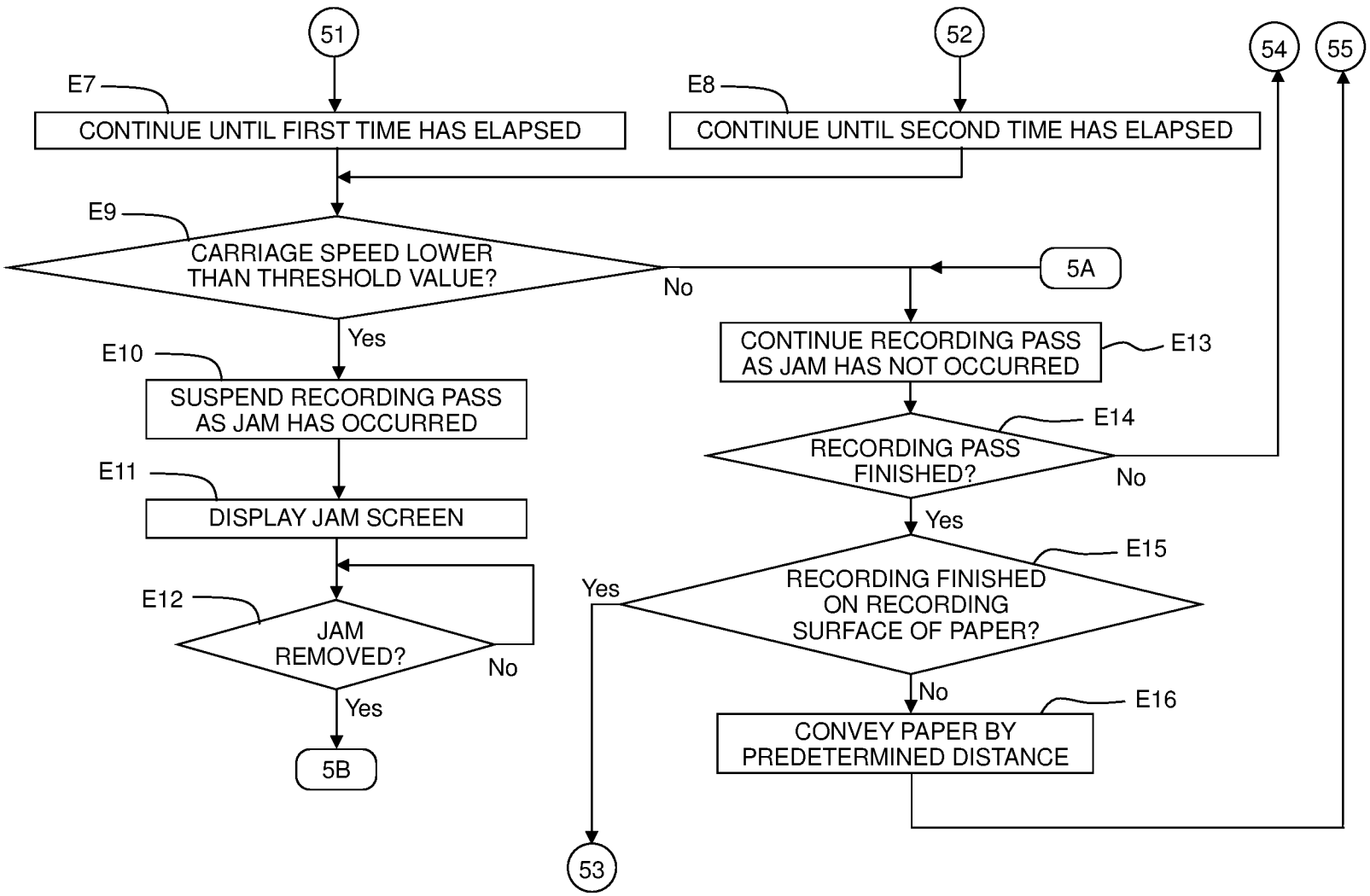
Figure 10C:
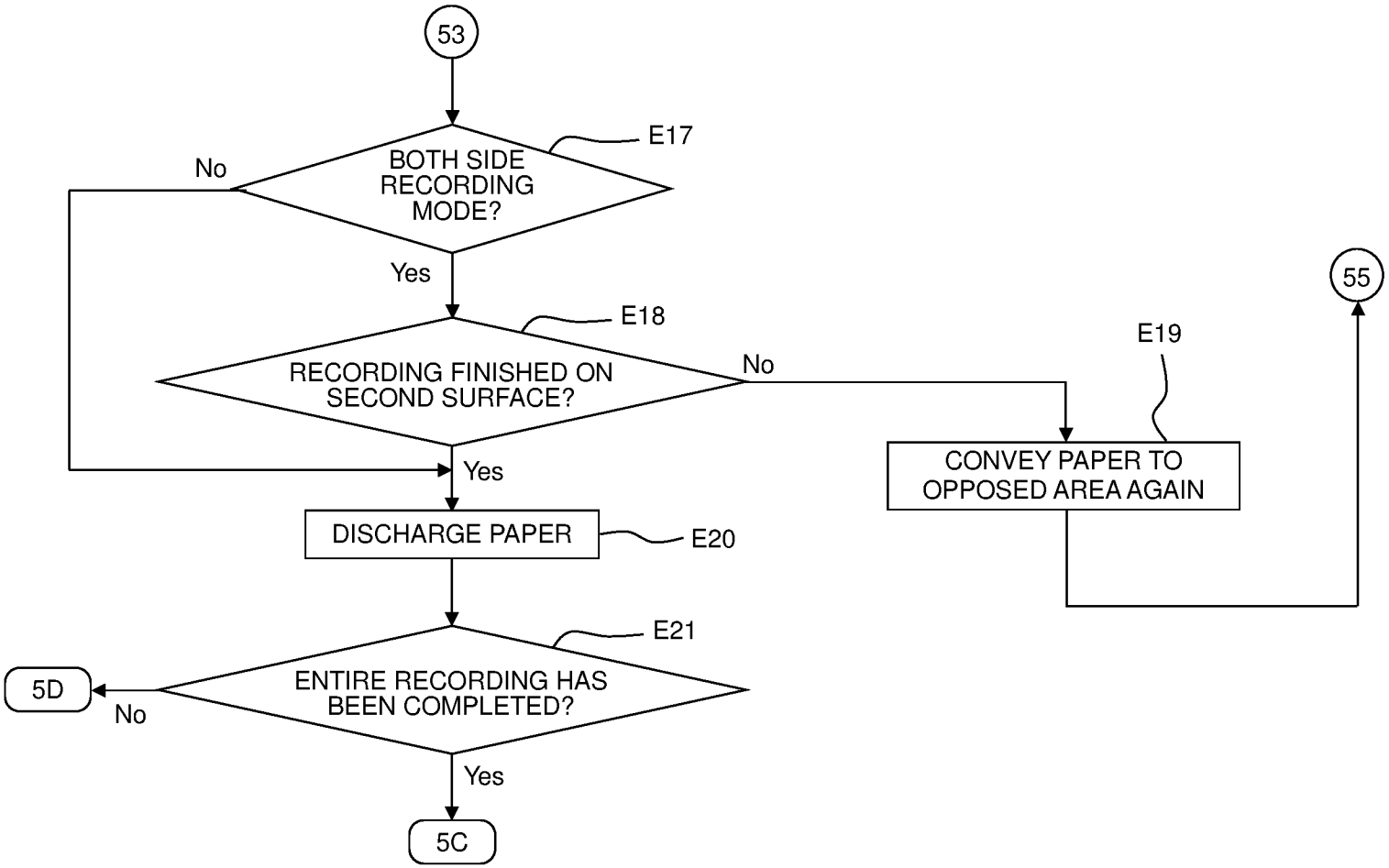

Next, the fourth modified embodiment will be explained. In the fourth modified embodiment, as shown in FIG. 10A, the CPU 101 carries out processes of E1 to E5 in the same manner as the processes of S1 to S5 described earlier on. Then, in the process of E5, if the carriage speed Vcr is determined as lower than the threshold value (E5: Yes), then the CPU 101 determines whether or not the target speed for the carriage 4 in the current recording pass is equal to or faster than a threshold speed (E6). If the target speed is determined as slower than the threshold speed (E6: No), then the CPU 101 continues to move the carriage 4 from the processing point of E5 (the first point of time) until the first time has elapsed (E7), and then the process proceeds to the step E9. On the other hand, if the target speed is determined in the process of E6 as equal to or faster than the threshold speed (E6: Yes), then the CPU 101 continues to move the carriage 4 from the processing point of E5 (the first point of time) until the second time has elapsed (E8), and then the process proceeds to the step E9. Then, the CPU 101 carries out processes of E9 to E21 in the same manner as the processes of S9 to S21.

In the above manner, in the fourth modified embodiment, the faster the target speed for the carriage 4, the longer the predetermined time is adjusted. Here, the faster the target speed for the carriage 4, the longer a convergence time becomes for the speed of the carriage 4 to converge within a small percent of the target speed after the vibration is applied. In particular, as described earlier on, the CPU 101 controls the movement of the carriage 4 by the feedback control based on the deviation between the target speed, and the current carriage speed Vcr calculated on the basis of the detected result by the detecting sensor 22. The period of the feedback control is the same as the period of acquiring the carriage speed Vcr. Therefore, the faster the target speed of the carriage 4, the shorter the control period. Further, under a PID control or the like, which is the basic control for the feedback control, the larger the change between the deviation in the last control period and the deviation in the current control period, the larger the value is set for the operation amount in the current control period. Therefore, the faster the target speed of the carriage 4, the shorter the control period; thereby the operation amount becomes larger and, as a result, the carriage 4 is more likely to change in speed excessively.

Here, when the target speed for the carriage 4 is either equal to or higher than or lower than the threshold speed, suppose that a vibration is applied to lower the current speed of the carriage 4 by the same degree of speed. On this occasion, if the target speed for the carriage 4 is equal to or higher than the threshold speed, then the convergence time is liable to become longer because the speed of the carriage 4 changes excessively due to the short control period in comparison with the case of being lower than the threshold speed. Therefore, when the target speed for the carriage 4 is equal to or higher than the threshold speed, if the predetermined time is short, then it is possible for the CPU 101 to mistakenly determine that a jam has occurred when the vibration is applied to the printer 1. Therefore, in the fourth modified embodiment, if the target speed for the carriage 4 is lower than the threshold speed, then the predetermined time is shortened. By virtue of this, because it is possible to determine the jam at an early time, it is possible to shorten the time from the point of the jam arising to the suspension of the recording pass. On the other hand, if the target speed for the carriage 4 is equal to or higher than the threshold speed, then by elongating the predetermined time, it is possible to improve the accuracy of determining whether or not a jam has occurred. In the fourth modified embodiment, the target speed for the carriage 4 is an example of the predetermined condition of the present teaching.

As explained above, the predetermined time may be adjusted according to various conditions. Note that in each of the first embodiment and the first modified embodiment to the fourth modified embodiment, the predetermined time is adjusted on the basis of any one of the five terms: the temperature measured by the temperature sensor 8, the state of the paper P being nipped by the conveyance roller pairs 42 and 43 for conveyance, the ink jetting amount jetted from the head 5 up to the first point of time, and the target speed for the carriage 4. However, the predetermined time may be adjusted on the basis of a plurality of terms. For example, predetermined points may be assigned to each of the states of the five terms. Then, the predetermined time may be adjusted according to the sum of the points corresponding to the current state for each of the five terms. One example will be explained below.

To the term of temperature, "one point" is assigned if the temperature is equal to or higher than the threshold temperature, whereas "two points" is assigned if the temperature is lower than the threshold temperature. To the term of nip state, "one point" is assigned if the paper P is nipped by only one of the roller pairs, whereas "two points" is assigned if the paper P is nipped by both of the roller pairs. To the term of recording surface, "one point" is assigned if the recording surface is the second surface, whereas "two points" is assigned if the recording surface is the first surface. To the term of ink jetting amount, "one point" is assigned if the ink jetting amount is equal to or more than the threshold quantity, whereas "two points" is assigned if the ink jetting amount is less than the threshold quantity. Further, to the term of target speed for the carriage 4, "one point" is assigned if the target speed is lower than the threshold speed, whereas "two points" is assigned if the target speed is equal to or higher than the threshold speed. Then, the sum of the points is calculated according to the current state for each of the five terms. The predetermined time may be adjusted to the first time if the sum is less than "eight points", whereas the predetermined time be adjusted to the second time if the sum is equal to or more than "eight points". Further, the sum may be calculated after having weighted the respective terms in accordance with the importance.

Next, a fifth modified embodiment will be explained below, which is another modified embodiment based on the first embodiment. In the aforementioned first embodiment, at one second point of time after the predetermined time has elapsed since the first point of time at which the carriage speed Vcr is determined as lower than the threshold value, the carriage speed Vcr is referred to for determining whether or not a jam has occurred. However, in the fifth modified embodiment, at a plurality of second points of time after the predetermined time has elapsed since the first point of time, the carriage speed Vcr is referred to for determining whether or not a jam has occurred.

Figure 11A:
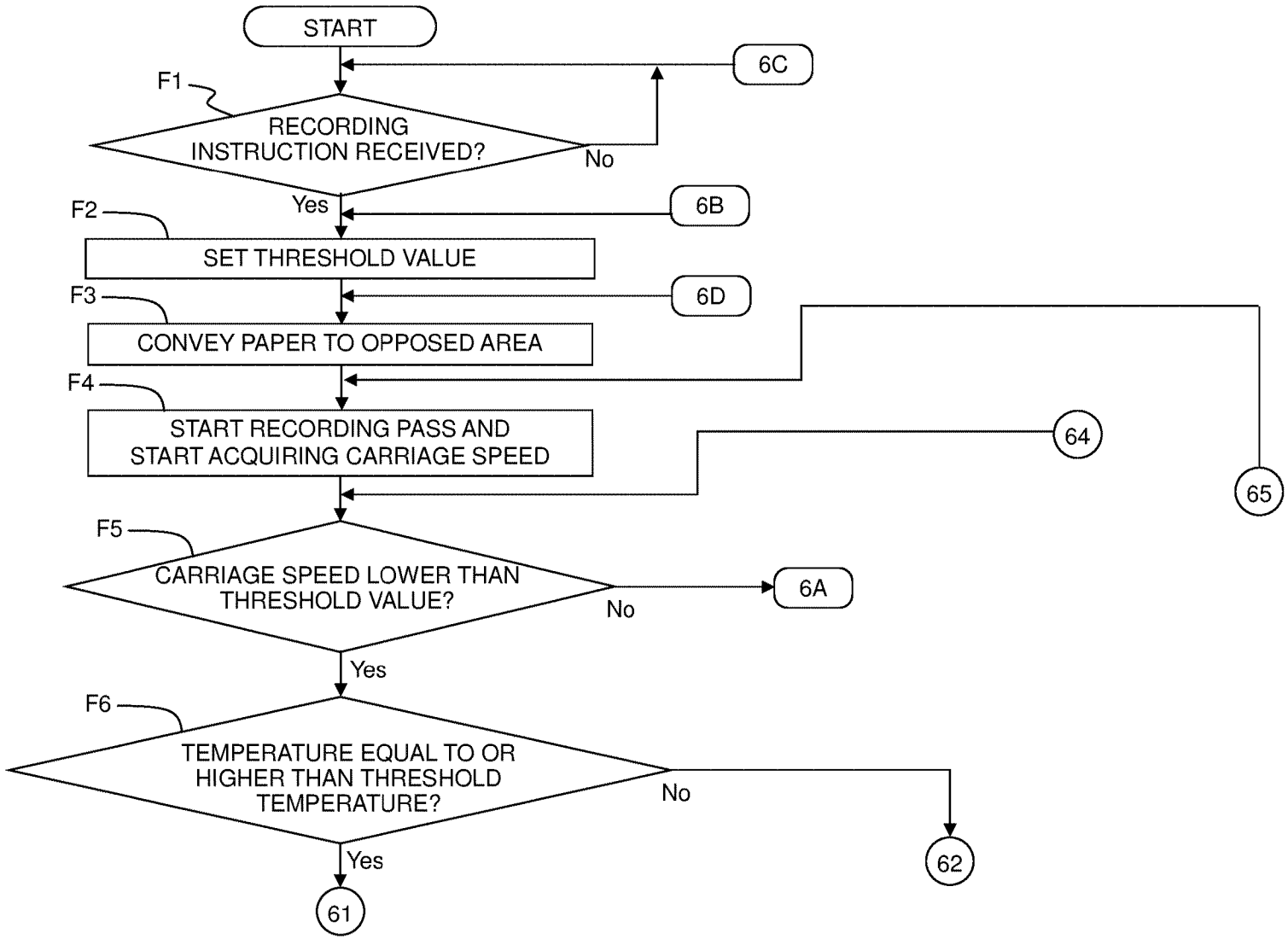
FIGS. 11A to 11C are a flow chart showing an operation of the ink jet printer according to a fifth modified embodiment.
Figure 11B:
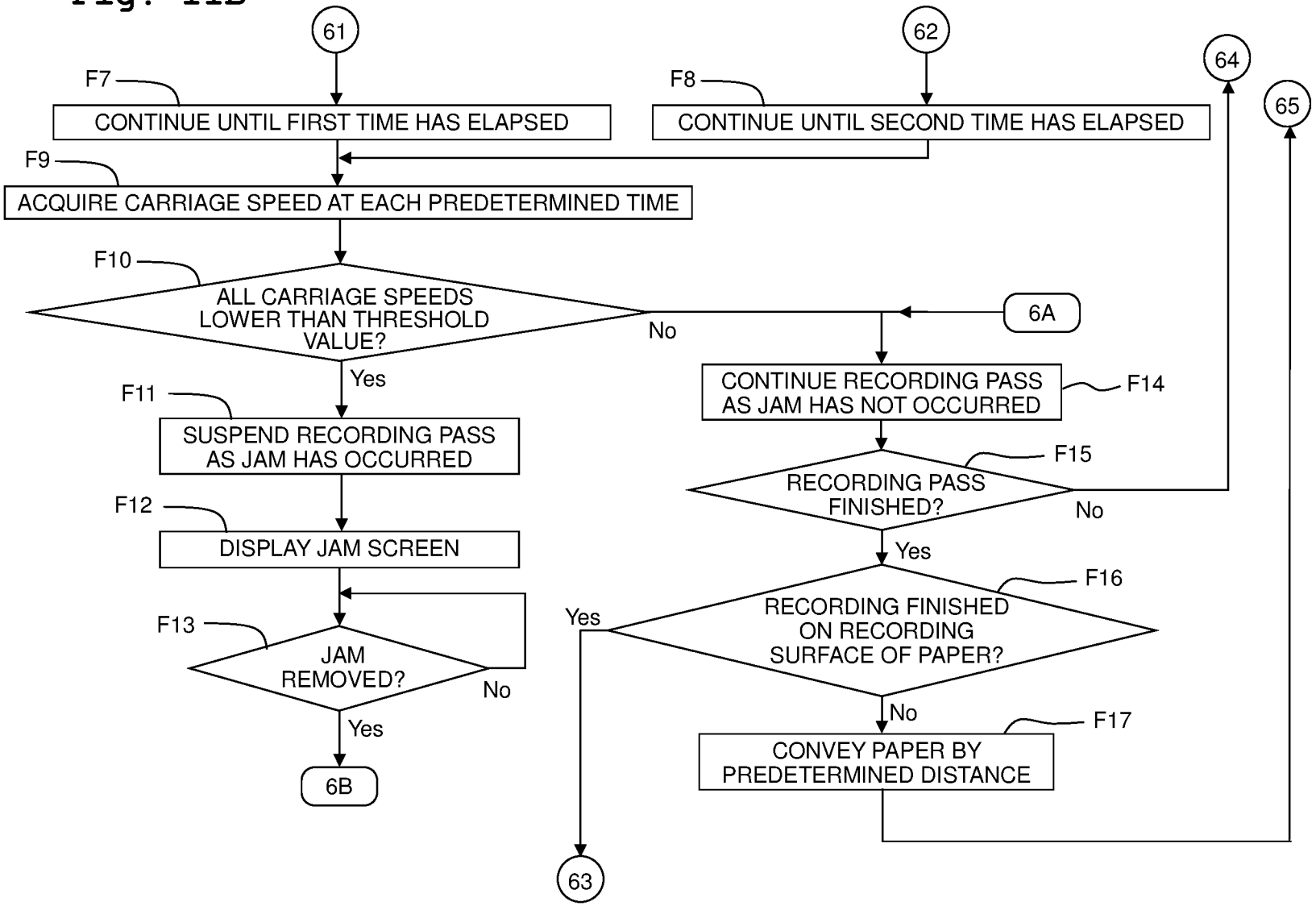
Figure 11C:
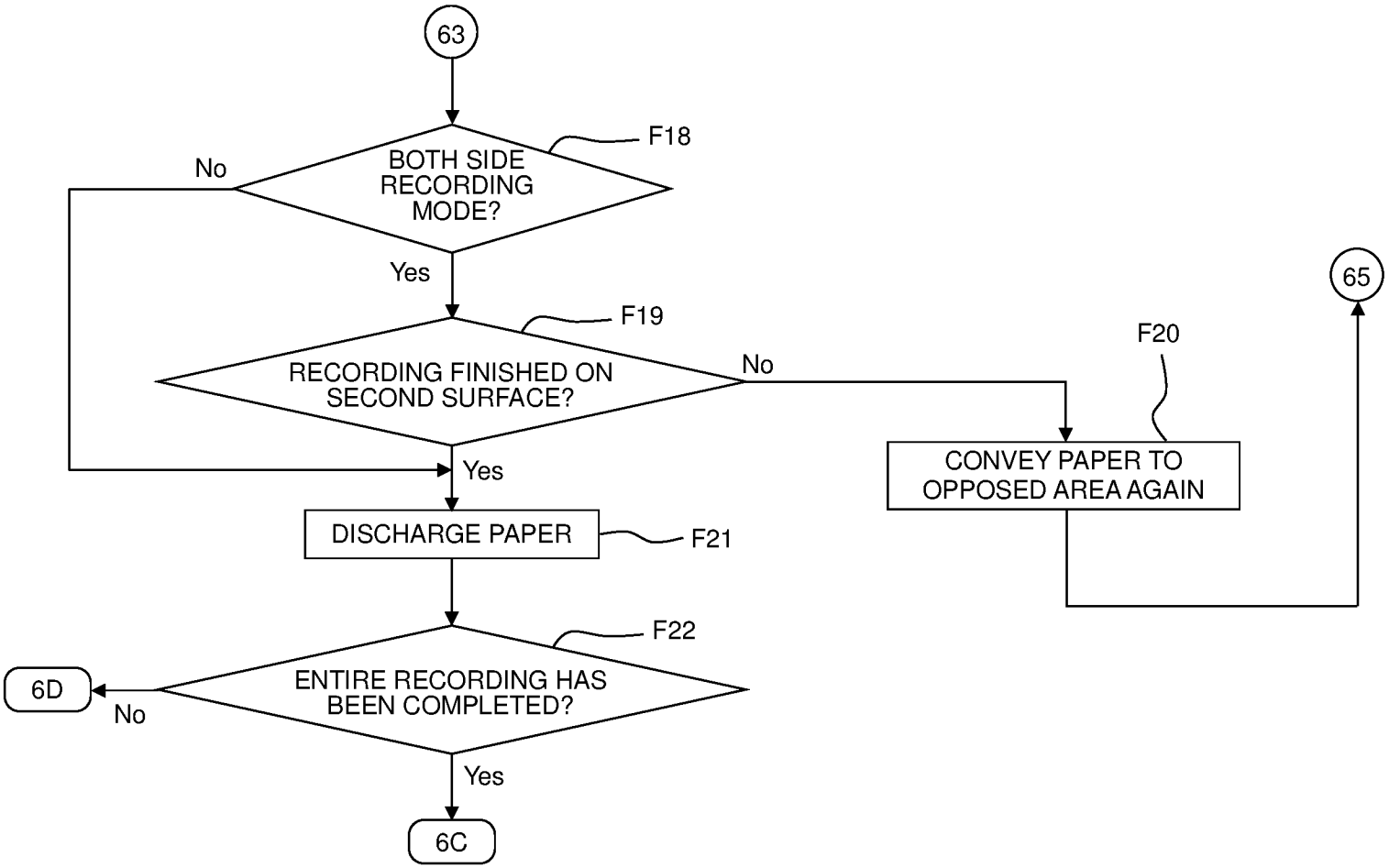

In the fifth modified embodiment, as shown in FIG. 11A, the CPU 101 carries out processes of F1 to F5 in the same manner as the processes of S1 to S5 described earlier on. Then, the CPU 101 acquires the carriage speed Vcr at each time when a predetermined time has passed, and acquires the carriage speeds Vcr at the plurality of second points of time (five second points of time, for example) after the predetermined time has elapsed since the first point of time (F9). Then, the CPU 101 determines whether or not all carriage speeds Vcr acquired at the second points of time are lower than the threshold value (F10). If all of the acquired carriage speeds Vcr are determined as lower than the threshold value (F10: Yes), then the CPU 101 determines that a jam has occurred so as to control the carriage motor 16 to stop the carriage 4 and suspend the recording pass (F11). Then, the CPU 101 carries out processes of F12 and F13 in the same manner as the processes of S11 and S12 described earlier on.

On the other hand, in the process of F10, if any of the carriage speeds Vcr acquired at the second points of time is determined as equal to or higher than the threshold value (F10: No), then the CPU 101 determines that no jam has occurred so as to continue the recording pass (F14). Then, the CPU 101 carries out processes of F15 to F22 in the same manner as the processes of S14 to S21 described earlier on.

In the above manner, in the fifth modified embodiment, whether or not a jam has risen is determined by referring to the carriage speeds Vcr at the plurality of second points of time. Here, after one carriage speed Vcr becomes lower than the threshold value due to a jam arising, the carriage speed Vcr may be temporarily equal to or higher than the threshold value due to inference of some noises and the like. Therefore, in the case of referring to the only carriage speed Vcr at one second point of time, regardless of a jam being arising in reality, it is possible for the CPU 101 to mistakenly determine that no jam has occurred. However, in the fifth modified embodiment, because of referring to the carriage speeds Vcr at the plurality of second points of time, it is possible to raise the accuracy of determining whether or not a jam has occurred.

Note that in the fifth modified embodiment, by determining whether or not all of the carriage speeds Vcr acquired at the second points of time are lower than the threshold value, whether or not a jam has occurred is determined. However, without being particularly limited to that, for example, whether or not a jam has occurred may be determined by determining whether or not an average value of the carriage speeds Vcr acquired at the second points of time is lower than the threshold value.

Second Embodiment

Next, referring to FIGS. 12A to 13C, a second embodiment will be explained. The second embodiment differs from the first embodiment in the method for determining whether or not a jam has occurred. In the following explanation, the same numerals or alphanumerals will be assigned to the same parts as in the first embodiment, and any explanation therefor be omitted.

As described earlier on, if a jam occurs, then the carriage speed Vcr decreases comparatively gradually, whereas if some vibration is applied from the outside, then the carriage speed Vcr decreases comparatively rapidly. That is, the speed decrease rate per unit time of the carriage speed Vcr when a jam has occurred is smaller than the speed decrease rate per unit time of the carriage speed Vcr when a vibration is applied from the outside.

Figure 12A:
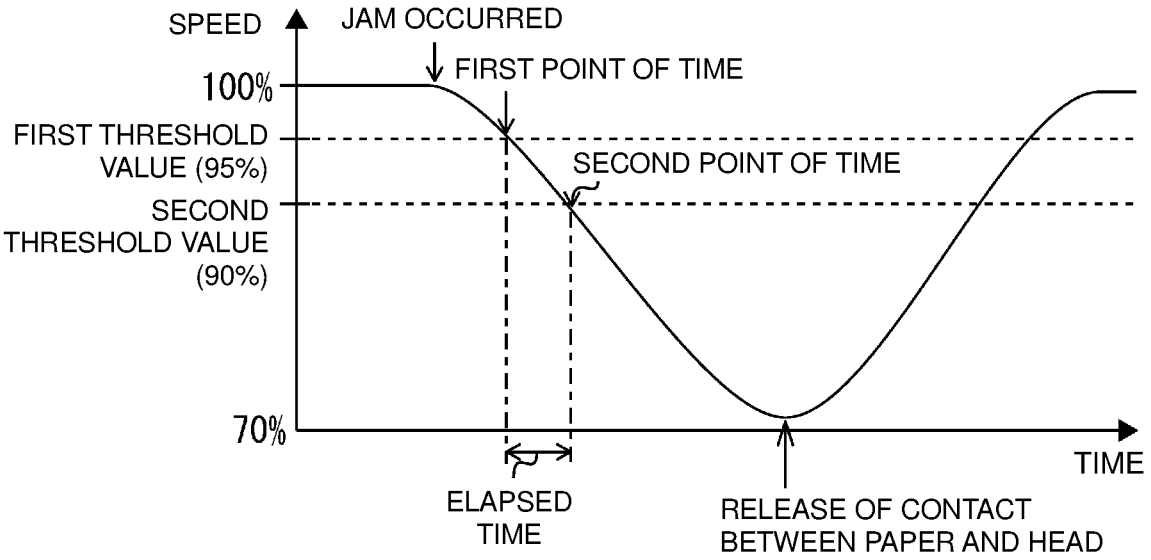
FIG. 12A is an illustrative graph for explaining the elapsed time of the carriage speed changing from a first threshold value to a second threshold value, when a paper jam occurs.
Figure 12B:
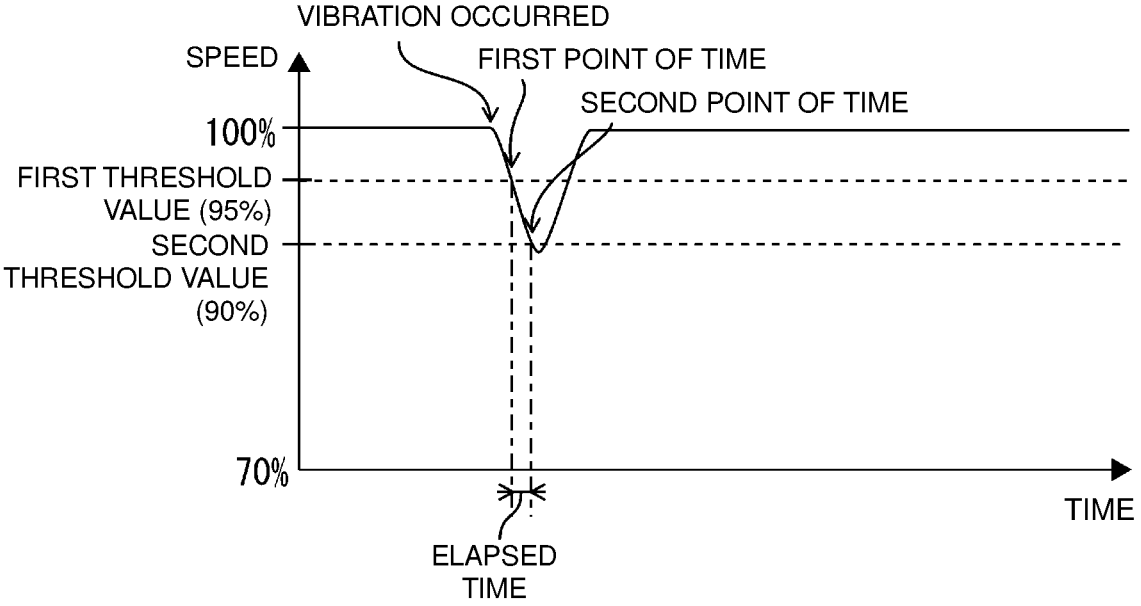
FIG. 12B is an illustrative graph for explaining the elapsed time of the carriage speed changing from the first threshold value to the second threshold value, when a vibration occurs.

In the second embodiment, in view of this phenomenon as shown in FIGS. 12A and 12B, the CPU 101 sets up a first threshold value and a second threshold value smaller than the first threshold value. For example, if the first threshold value is set at the value being 95% of the target speed, then the second threshold value is set to the value being 90% of the target speed. Then, the CPU 101 registers, as the second point of time, the point when the carriage speed Vcr becomes lower than the second threshold value after the first point of time when the carriage speed Vcr is determined as lower than the first threshold value in the recording pass. The smaller the speed decrease rate per unit time of the carriage speed Vcr, the longer the elapsed time from the first point of time to the second point of time. Therefore, as shown in FIGS. 12A and 12B, the elapsed time in a case where a jam has occurred is longer than a case where a vibration is applied from the outside. Then, the CPU 101 determines that a jam has occurred if the elapsed time is equal to or higher than the threshold time, but no jam has occurred if the elapsed time is lower than the threshold time.

Figure 13A:
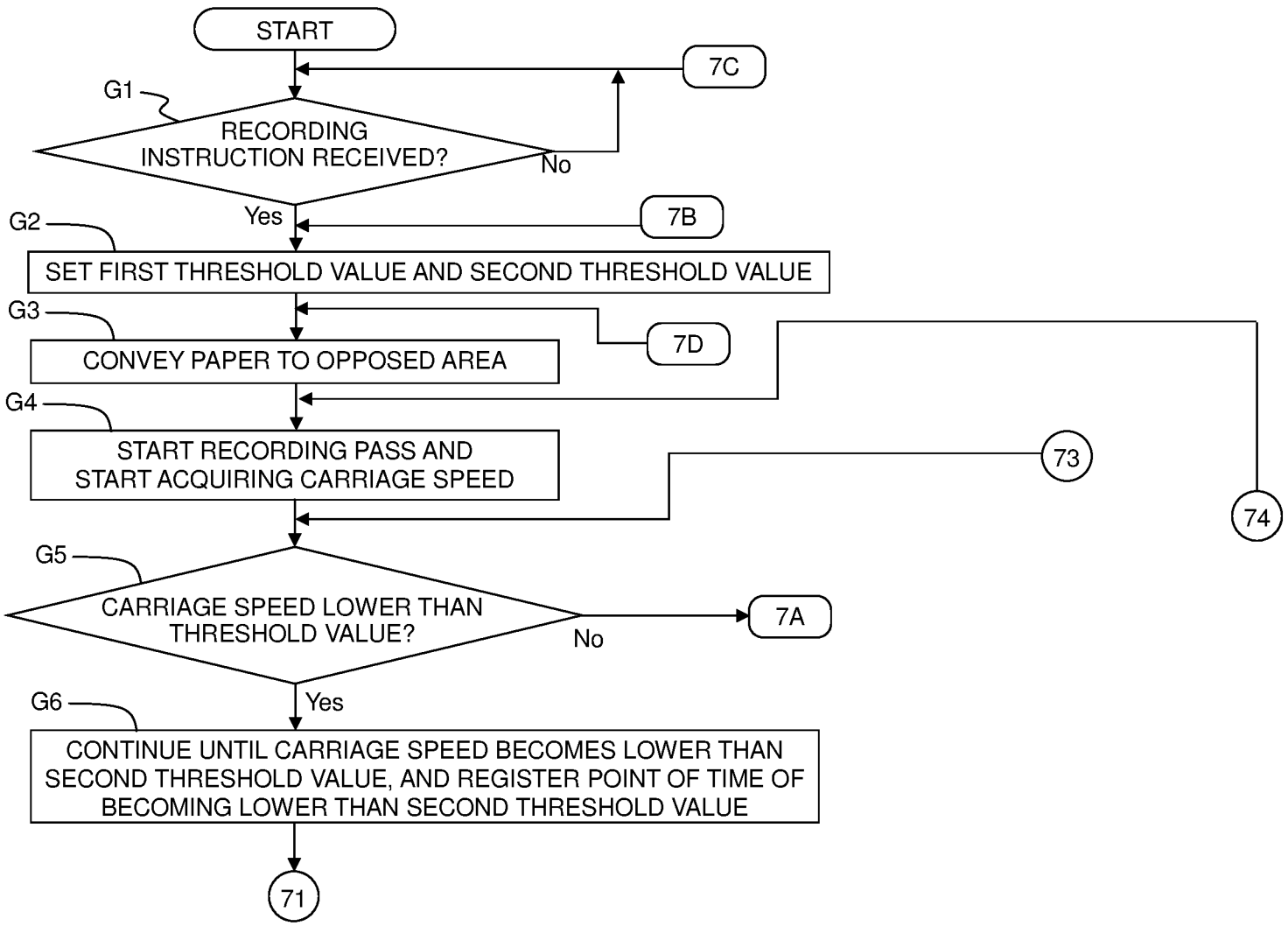
FIGS. 13A to 13C are a flow chart showing an operation of the ink jet printer according to a second embodiment.
Figure 13B:
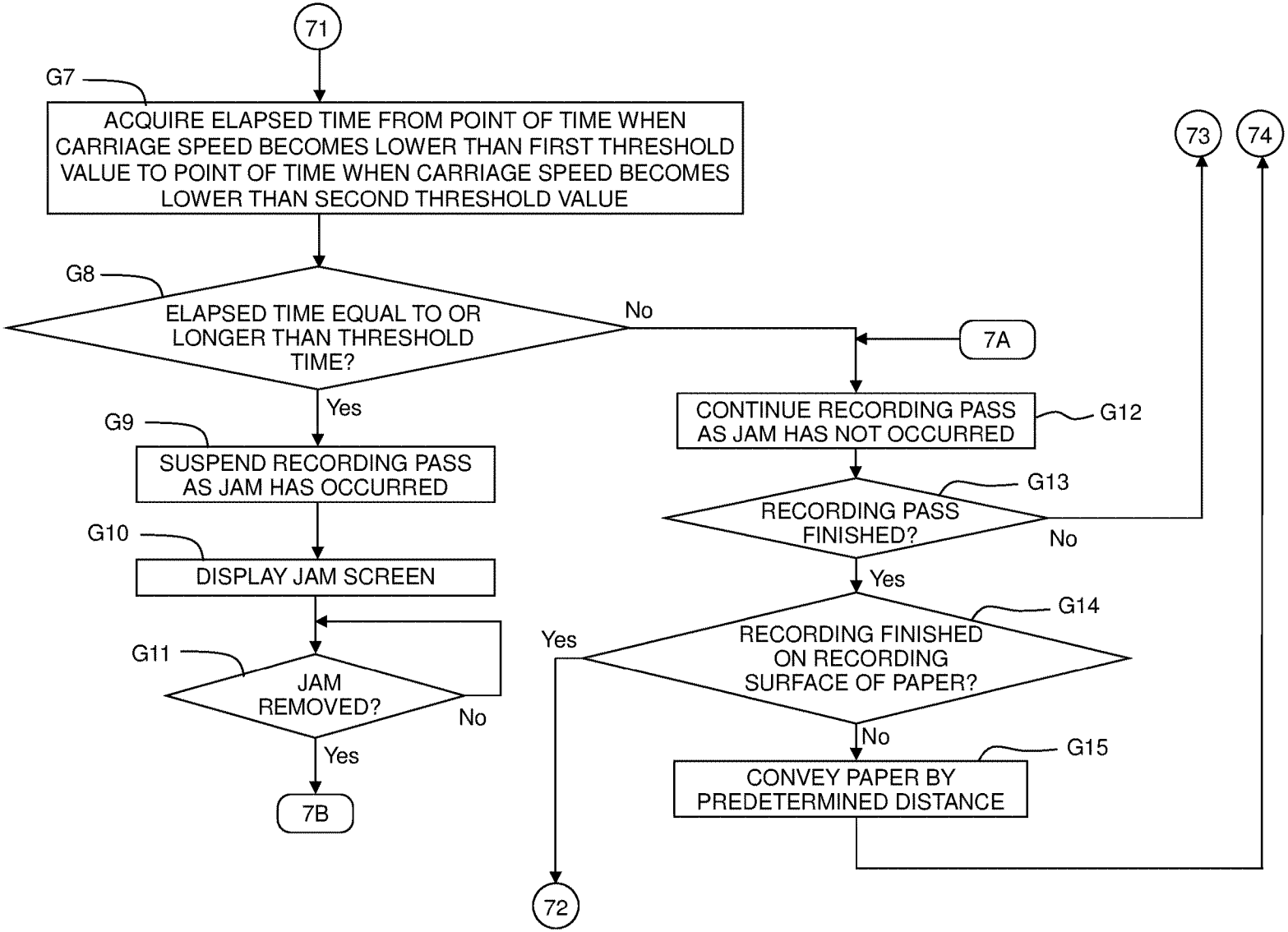
Figure 13C:
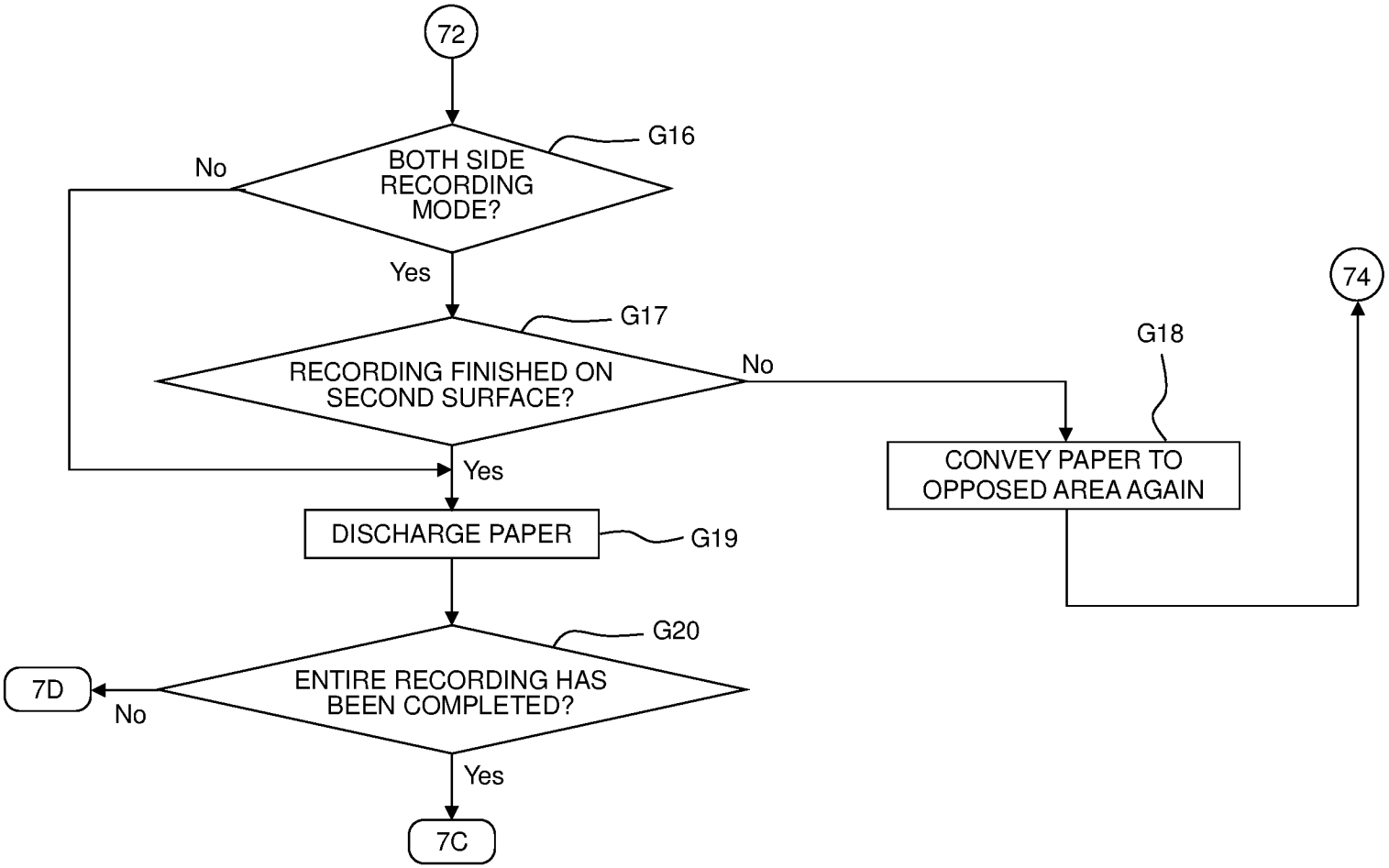

Referring to FIGS. 13A to 13C, a serious of operations of the printer 1 will be explained below according to the second embodiment.

First, the CPU 101 carries out processes of G1 to G4 in the same manner as the processes of S1 to S4 described earlier on. However, in the threshold value setting process of G2, two threshold values are set: the first threshold value and the second threshold value. Then, after the process of G4, the CPU 101 determines whether or not the carriage speed Vcr acquired currently is lower than the first threshold value set in the process of G2 (G5). If the carriage speed Vcr is equal to or higher than the first threshold value (G5: No), then the CPU 101 determines that no jam has occurred such that the recording pass is carried out continuously (G12), and then the process proceeds to G13.

On the other hand, if the carriage speed Vcr is determined as lower than the first threshold value (G5: Yes), then the CPU 101 continues to move the carriage 4 until the acquired carriage speed Vcr is determined as lower than the second threshold value, and registers the point of the determination as lower than the second threshold value as the second embodiment (G6). On this occasion, if the carriage speed Vcr does not decrease to be lower than the second threshold value even though the predetermined time has elapsed since the point when the carriage speed Vcr is determined as lower than the first threshold value, then the process may return to G5.

Next, the CPU 101 acquires the elapsed time from the processing point of G5 (the first point of time) to the registered second point of time (G7), and determines whether or not this elapsed time is equal to or longer than the threshold time (G8). If the elapsed time is equal to or longer than the threshold time (G8: Yes), then the CPU 101 determines to control the carriage motor 16 to stop the carriage 4 and suspend the recording pass as a jam has occurred (G9). Then, the CPU 101 carries out the processes of G9 to G11 in the same manner as the processes of S10 to S12 described earlier on.

In the process of G8, if the elapsed time is determined as lower than the threshold time (G8: No), then the CPU 101 determines to continue the recording pass as no jam has occurred (G12). Then, the CPU 101 carries out the processes of G13 to G20 in the same manner as the processes of S14 to S21 described earlier on.

Hereinabove, according to the second embodiment, at the first point of time where the carriage speed Vcr is determined as lower than the first threshold value, without determining whether to suspend or to continue the recording pass, the determination is made on the basis of the elapsed time from the first point of time to the second point of time when the carriage speed Vcr is determined as lower than the second threshold value. By virtue of this, because it is possible to raise the accuracy of determining whether or not a jam has occurred, it is possible to lower the possibility of damaging the head 5 while reducing the possibility of unnecessary suspension of the recording pass.

As a modified embodiment based on the second embodiment, a plurality of second threshold values different from each other may be set up, and the second points of time be registered when the carriage speeds Vcr are determined as lower than the second threshold values, respectively. Then, the elapsed times from the first point of time to the second points of time are acquired such that whether or not a jam has risen may be determined on the basis of the acquired elapsed times. For example, by determining whether or not an average value of the acquired elapsed times is equal to or higher than a predetermined threshold time, whether or not a jam has occurred may be determined. According to this modified embodiment, because it is possible to reduce the influence of noises and the like, it is possible to raise the accuracy of determining whether or not a jam has occurred.

While the embodiments of the present teaching were explained above, the present teaching is not limited to those embodiments described above but can be changed and modified in various manners as far as without departing from the scope and true spirit set forth in the appended claims. For example, in the first embodiment described earlier on, the predetermined time is adjustable through two steps. However, the predetermined time may be adjusted through three steps or more in further detailed manner. Further, the predetermined time may be set as not adjustable. Further, in the first embodiment described earlier on, the threshold value at the first point of time and the threshold value at the second point of time are the same for the comparison with the carriage speed Vcr. However, it is not necessary to be the same value.

In the above embodiments, the detecting sensor 22 is configured to detect the non-transmission areas 21*b* for the encoder 7 as the reference index. However, the detecting sensor 22 may be configured to detect the transmission areas 21*a* as the reference index. Further, the encoder 7 is a linear motor encoder of the so-called transmission type. However, without being limited to that, the encoder 7 may be a linear motor encoder of the so-called reflection type. Further, the encoder may be of other types than the optical type and, for example, a magnetic encoder may be adopted. In such a case, the aforementioned non-transmission areas 21*b* can be magnetic areas whereas the transmission areas 21*a* be non-magnetic areas.

Further, in the above embodiments, the "speed data" is the carriage speed Vcr. However, it may not be the carriage speed Vcr per se but a speed parameter value with respect to the carriage speed Vcr. For example, the "speed data" may be the clock frequency CK. Further, the threshold values may be fixed values.

Further, the temperature sensor 8 acquires the temperature per se. However, it may acquire a parameter value with respect to the temperature. The parameter value may be such that the higher the temperature, the larger the value of the parameter, or the higher the temperature, the smaller the value of the parameter.

When a jam is determined as arising in a recording pass being carried out such that if the recording pass shall be suspended, the movement of the carriage 4 is stopped. However, without being limited to that, the carriage 4 may be moved in the reversed direction from the advancing direction for the carriage 4 during that recording pass. Until a jam is determined as arising, because there is no contact between the head 5 and the paper P, even though the carriage 4 is moved in the reversed direction from the advancing direction, there is a low possibility for the head 5 to contact with the paper P. Therefore, even though the carriage 4 is moved in the reversed direction from the advancing direction, there is a low possibility for the head 5 to be damaged and/or the jam to be worsened.

Further, the explanation was made with examples of applying the present teaching to a printer which jets an ink from nozzles to record image on recording paper. However, without being limited to that, it is also possible to apply the present teaching to image recording apparatuses which jet a liquid to any jetting objects other than the paper P. For example, it is possible to apply the present teaching to an image recording apparatus which jets a liquid other than inks such as a wiring pattern material or the like to a wiring substrate. It is also possible to apply the present teaching to an image recording apparatus which records image by jetting an ink to cases of mobile terminals such as smartphones and the like, cardboards, resins, and the like.

What is claimed is:

1. An image recording apparatus comprising:

a carriage configured to reciprocatingly move in a scanning direction;

a head mounted on the carriage and configured to jet liquid;

a speed sensor configured to acquire speed data related to speed of the carriage; and a controller configured to:

record an image on a recording medium by carrying out a recording pass in which the liquid is jetted from the head toward the recording medium while moving the carriage once toward one side in the scanning direction;

determine whether the speed indicated by the speed data acquired by the speed sensor is lower than a threshold value when moving the carriage in the recording pass; and based on determination at a first point of time in the recording pass that the speed indicated by the speed data is lower than the threshold value, determine whether to suspend or continue the recording pass while moving the carriage, by referring to the speed data acquired by the speed sensor at a second point of time in the recording pass which is after a predetermined time since the first point of time.

2. The image recording apparatus according to claim 1, wherein the controller is configured to suspend the recording pass in a case that the speed indicated by the speed data at the second point of time is lower than the threshold value, and the controller is configured to continue the recording pass in a case that the speed indicated by the speed data at the second point of time is equal to or higher than the threshold value.

3. The image recording apparatus according to claim 2, wherein the controller is configured to adjust the length of the predetermined time according to a predetermined condition.

4. The image recording apparatus according to claim 3, wherein the controller is configured to make the predetermined time longer as a target speed which is the maximum speed of the carriage in the recording pass becomes higher.

5. The image recording apparatus according to claim 3, wherein the controller is configured to make the predetermined time shorter as a jetting amount of the liquid, which is jetted from the head from a start time of recording the image to the first point of time, increases.

6. The image recording apparatus according to claim 3, further comprising a conveyer configured to convey the recording medium in a conveyance direction intersecting with the scanning direction, wherein the conveyer has an upstream roller pair positioned at the upstream side of the head in the conveyance direction and a downstream roller pair positioned at the downstream side of the head in the conveyance direction, the upstream roller pair being configured to convey the recording medium in the conveyance direction while nipping the recording medium therebetween, the downstream roller pair being configured to receive the recording medium from the upstream roller pair and convey the recording medium in the conveyance direction while nipping the recording medium therebetween, and the controller is configured to make the predetermined time shorter in a case that the recording medium is nipped by one of the upstream roller pair and the downstream roller pair in the recording pass, as compared to a case that the recording medium is nipped by both of the upstream roller pair and the downstream roller pair.

7. The image recording apparatus according to claim 3, further comprising a temperature sensor, wherein the controller is configured to make the predetermined time shorter as a temperature measured by the temperature sensor rises.

8. The image recording apparatus according to claim 3, wherein the controller is further configured to record the image on the recording medium having a first surface and a second surface opposite to the first surface, and the controller is configured to make the predetermined time shorter in a case that part of the image is recorded on the first surface of the recording medium and thereafter the rest of the image is recorded on the second surface of the recording medium, as compared with a case that the part of the image is recorded on the first surface of the recording medium.

9. The image recording apparatus according to claim 3, further comprising a temperature sensor configured to acquire a parameter value related to temperature, wherein the controller is configured to adjust the length of the predetermined time based on the parameter value acquired by the temperature sensor.

10. The image recording apparatus according to claim 1, wherein the controller is configured to:

register, as the second point of time, a point of time which is after the first point of time and at which the speed indicated by the speed data acquired by the speed sensor becomes lower than another threshold value smaller than the threshold value;

acquire elapsed time from the first point of time to the second point of time;

suspend the recording pass in a case that the elapsed time is equal to or longer than a threshold time; and continue the recording pass in a case that the elapsed time is shorter than the threshold time.

11. The image recording apparatus according to claim 1, wherein the second point of time includes multiple points of time in the recording pass at which the predetermined time or more has elapsed since the first point of time, and the controller is configured to determine whether to suspend or continue the recording pass by referring to the speed data acquired by the speed sensor at the multiple points of time.

12. The image recording apparatus according to claim 1, wherein the speed data indicates the speed of the carriage.

13. The image recording apparatus according to claim 1, wherein the controller is configured to suspend the recording pass by stopping the carriage which is being moved.

* * * * *